United States Patent [19]

Manaka et al.

[11] 4,354,238

[45] Oct. 12, 1982

[54] METHOD OF CONTROLLING AIR-FUEL RATIO OF INTERNAL COMBUSTION ENGINE SO AS TO EFFECTIVELY MAINTAIN THE AIR FUEL RATIO AT A DESIRED AIR-FUEL RATIO OF λ=1

[75] Inventors: Toshio Manaka; Takeshi Atago; Toshio Ishii; Yasunori Mouri, all of Katsuta, Japan

[73] Assignee: Hitachi, Ltd., Tokyo, Japan

[21] Appl. No.: 162,481

[22] Filed: Jun. 24, 1980

[30] Foreign Application Priority Data

Jul. 2, 1979 [JP] Japan ..... 54-82659

[51] Int. Cl.[3] ..... F02B 3/04; F02D 35/00

[52] U.S. Cl. ..... 364/431.05; 123/480; 123/489; 364/431.12

[58] Field of Search ..... 123/437, 438, 440, 489, 123/589; 364/431.04, 431.05, 431.06, 431.11, 431.12

[56] References Cited

U.S. PATENT DOCUMENTS

| | | | |
|---|---|---|---|
| 4,056,932 | 8/1977 | Nakamura et al. | 123/589 X |
| 4,153,023 | 5/1979 | Asano et al. | 123/489 X |
| 4,224,910 | 9/1980 | O'Brien | 123/489 X |
| 4,249,496 | 2/1981 | Shimazaki et al. | 123/440 X |
| 4,251,990 | 2/1981 | Norimatsu et al. | 123/489 X |
| 4,252,098 | 2/1981 | Tomczak et al. | 123/437 |
| 4,255,789 | 3/1981 | Hartford et al. | 364/431 |
| 4,270,503 | 6/1981 | Pomerantz | 123/438 |
| 4,290,107 | 9/1981 | Suda et al. | 364/431.06 |
| 4,294,212 | 10/1981 | Aoki | 123/440 |

*Primary Examiner*—Felix D. Gruber

*Attorney, Agent, or Firm*—Antonelli, Terry & Wands

[57] ABSTRACT

A method of controlling the air-fuel ratio so as to be effectively maintained at a desired air-fuel ratio of λ=1 is composed of a combination of an electronic map control for effecting the air-fuel ratio control on the basis of map data read out from a data map stored in ROM as air-fuel ratio control data in correspondence to various operation parameters of an engine and an $O_2$-feedback control for controlling the air-fuel ratio on the basis of oxygen quantity detected from the exhaust gas. Upon the occurrence of changes in the control quantity for a predetermined number of times in the course of the $O_2$-control, the latter is changed over to the map control. At that time point, a control quantity for the map control is corrected on the basis of a mean control quantity during the $O_2$-feedback control. Unless a significant variation takes place in the engine operating conditions, the map control is continued for a predetermined time and then changed over to the $O_2$-control. Upon the occurrence of a significant variation in the engine operating conditions, the map feedback control is immediately changed over to the $O_2$-control.

32 Claims, 19 Drawing Figures

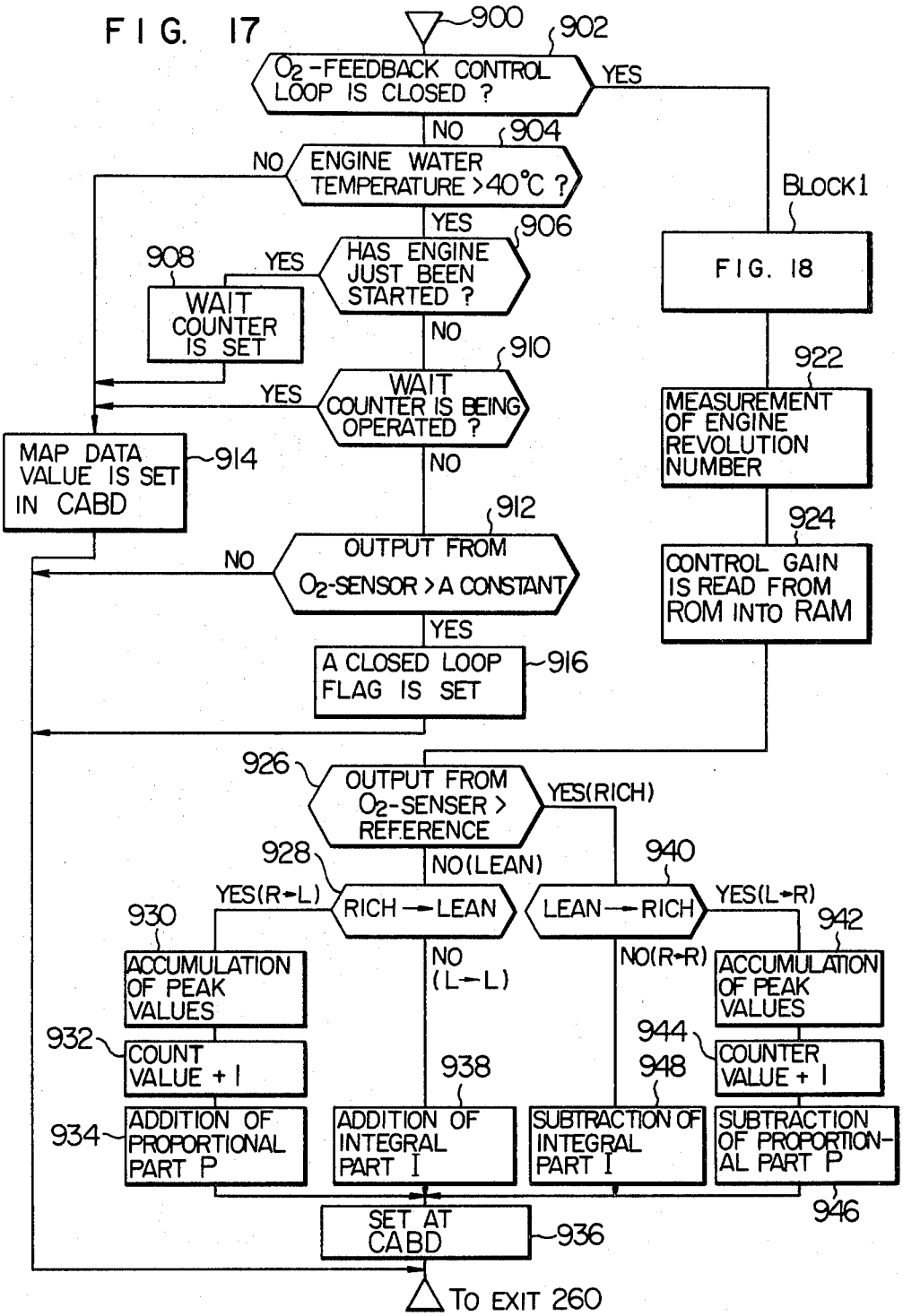
FIG. 17
900
902
O2-FEEDBACK CONTROL LOOP IS CLOSED ?
YES
NO
904
ENGINE WATER TEMPERATURE >40°C ?
NO
YES
906
HAS ENGINE JUST BEEN STARTED ?
908
YES
WAIT COUNTER IS SET
NO
910
WAIT COUNTER IS BEING OPERATED ?
YES
NO
MAP DATA VALUE IS SET IN CABD
914
912
OUTPUT FROM O2-SENSOR > A CONSTANT
NO
YES
A CLOSED LOOP FLAG IS SET
916
BLOCK1
FIG. 18
922
MEASUREMENT OF ENGINE REVOLUTION NUMBER
924
CONTROL GAIN IS READ FROM ROM INTO RAM
926
OUTPUT FROM O2-SENSER > REFERENCE
YES(RICH)
NO(LEAN)
928
RICH → LEAN
YES(R→L)
940
LEAN → RICH
YES(L→R)
930
ACCUMULATION OF PEAK VALUES
NO (L→L)
NO(R→R)
942
ACCUMULATION OF PEAK VALUES
932
COUNT VALUE + 1
938
948
944
COUNTER VALUE + 1
934
ADDITION OF PROPORTIONAL PART P
ADDITION OF INTEGRAL PART I
SUBTRACTION OF INTEGRAL PART I
SUBTRACTION OF PROPORTIONAL PART P
946
SET AT CABD
936
TO EXIT 260

METHOD OF CONTROLLING AIR-FUEL RATIO OF INTERNAL COMBUSTION ENGINE SO AS TO EFFECTIVELY MAINTAIN THE AIR FUEL RATIO AT A DESIRED AIR-FUEL RATIO OF $\lambda=1$

FIELD OF THE INVENTION

The present invention relates to a method of varying controllably the fuel quantity and the air flow supplied to an internal combustion engine in dependence on operating conditions of the engine.

BACKGROUND OF THE INVENTION

In hitherto known methods of electronically controlling the air-fuel ratio of air-fuel mixture supplied to an internal combustion engine, there is usually adopted a so-called "feedback control based on an $O_2$-sensor" (hereinafter referred to simply as $O_2$-control or $O_2$-feedback control in which a carburetor is controlled through a feedback loop on the basis of the quantity of oxygen contained in the engine exhaust gas and detected by an $O_2$-sensor. The conventional $O_2$-feedback control method however cannot assure the control of the air-fuel ratio with a high accuracy particularly in the transient operating states of the engine in which operating conditions of the engine undergo remarkable variations, because the $O_2$-feedback control has a rather poor response behavior due to an inherent delay in response.

Further, since a proportional plus integral control is performed with a predetermined gain in the $O_2$-feedback control, the air-fuel ratio will vary with a certain periodicity as a function of a periodical change in the control quantity, resulting in an unsmooth rotation of the engine, whereby the vehicle body is subjected to undesirable vibrations due to the involved hunting and surging, to a great disadvantage.

There has hitherto been also known an air-fuel ratio control method in which optimum control data (i.e. data for controlling the air-fuel ratio at an optimum) are previously prepared in dependence on corresponding parameters of the engine operation such as the number of revolutions the engine, negative pressure (degree of vacuum) in an intake manifold and so forth in the form of a data map (or data table), wherein the air-fuel ratio control is performed electronically by reading out relevant data from the data map. Hereinafter, this control is referred to as map control.

SUMMARY OF THE INVENTION

An object of the invention is to provide an air-fuel ratio control method which is capable of controlling the air-fuel ratio with a high accuracy in dependence on the state of the exhaust gas and hence preventing the control accuracy from being degraded due to a delay in response in the transient states of the engine operation.

The air-fuel ratio control method according to the invention is characterized by the following features:

1. The air-fuel ratio of the air-fuel mixture which undergoes combustion in a combustion chamber or chambers of the engine is controlled as the function of a ratio of fuel supply quantity relative to a mass or quantity of oxygen which is expected to be fed to the combustion chamber and a correcting quantity for the fuel supply quantity which is determined in dependence on the state of the exhaust gas produced from the preceding combustion. The correcting quantity is allowed to be modified on the basis of measurement only when the occasion requires, so that the correcting quantity currently in use is held valid until such modification is needed.

It is decided that the measurement of the correcting quantity is necessary, when the quantity or mass of oxygen introduced to the combustion chamber of the engine varies significantly or when a predetermined time has elapsed.

For modification of the correcting quantity, the fuel supply quantity is at first caused to vary in dependence on a predicted quantity or mass of oxygen expected to be introduced into the combustion chamber through feedback control of the air-fuel ratio which is effected on the basis of the output signal from an exhaust gas sensor such as an $O_2$-sensor, to thereby determine ultimately an optimum fuel supply quantity. The updated correcting quantity can be then determined by eliminating from the optimum fuel supply quantity a known fuel supply quantity read from the data map in correspondence to the predicted mass or quantity of oxygen to be introduced into the combustion chamber of the engine.

The fuel supply quantities or control quantities corresponding to the predicted oxygen quantities are stored in a memory in a form of the data table or a data map. The control method in which the control quantities are stored in this manner will hereinafter be referred to as the map control.

2. The map control is corrected with the air of feedback control data which are made use of in the $O_2$-control. More particularly, the map control is effected on the basis of a value obtained by adding to the map data, $D_M$ read out during the map control period, the difference $\Delta D_1$ between the mean value ($\alpha A$) of the control quantities for the $O_2$-control feedback and the map data ($D_{MO}$) at the time when the $O_2$-control is interrupted.

BRIEF DESCRIPTION OF THE DRAWINGS

The above and other objects, features and advantages of the invention will become more apparent from the following description with the accompanying drawings, in which:

FIGS. 17 and 18 show flow charts to illustrate an exemplary control process according to the invention.

DETAILED DESCRIPTION

Figure 1:
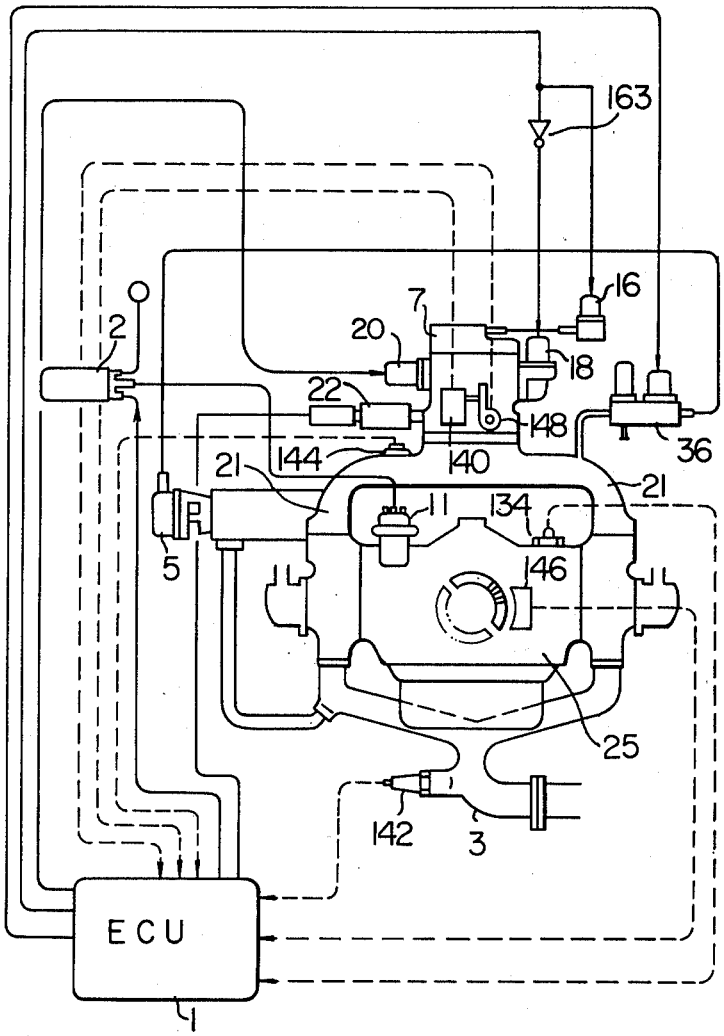
FIG. 1 shows a general arrangement of an internal combustion engine control system to which the invention may be applied in a preferred manner.

FIG. 1 shows an internal combustion engine control system to which the air-fuel control method according to the invention can be advantageously applied.

Referring now to FIG. 1, an internal combustion engine 25 includes an intake pipe 21 and an exhaust pipe 3, and a carburetor 7 is mounted on the intake pipe 21. The carburetor 7 is provided with a slow solenoid-operated valve 16 for controlling the air-fuel ratio (hereinafter referred to also as the A/F ratio) of the air-fuel mixture supplied by way of a low speed fuel system and is also provided with a main solenoid-operated valve 18 for controlling the A/F ratio of the air-fuel mixture supplied by way of a high-medium speed fuel system. When these solenoid-operated valves are not energized and do not participate in the control of the A/F ratio, the A/F ratio is then determined by the setting of the carburetor 7 so as to be variable within a predetermined range depending on the value of vacuum in the intake pipe 21. As shown in detail in FIG. 2, the carburetor 7 includes a bypass passage for supplying air and fuel to a point downstream of the throttle valve while bypassing the carburetor 7, and an air bypass control solenoid-operated valve 22 and a fuel bypass control solenoid-operated valve 20 for controlling the quantities of air and fuel respectively flowing through this bypass passage are associated with this bypass passage. A throttle sensor 140 for sensing the opening of the throttle valve is associated with the carburetor 7, and this throttle sensor 140 is connected to a throttle switch 148 generating an electrical output signal at a specific opening of the throttle valve.

The intake pipe 21 is provided with a vacuum sensor 144 for measuring the vacuum or negative pressure therein. An EGR valve 5 is provided for controlling the amount or rate of exhaust gas recirculation, and this EGR valve 5 is actuated by a pressure control valve 36. After the vacuum in the intake pipe 21 is regulated to a predetermined value, the pressure control valve 36 actuates the EGR valve 5 by applying thereto a pressure signal corresponding to an electrical signal supplied from an electronic control unit 1 which will hereinafter be simply referred to as an ECU. The ECU comprises an input/output circuit 108 as well as CPU, RAM and ROM shown in FIG. 2. The operation of the EGR valve 5 determines the quantity or rate of exhaust gas recirculation.

The engine 25 is provided with a temperature sensor 134 which senses the temperature of engine cooling water, hence, the temperature of the engine 25 (hereinafter, the engine cooling water temperature is called the engine temperature). This temperature sensor 134 generates an electrical output signal indicative of the sensed temperature of the engine 25. A rotation sensor 146 is associated with the crankshaft (not shown) of the engine 25 to generate a pulse signal REF representative of a reference crank angle in synchronism with the combustion cycle in the engine 25 and a pulse signal POS indicative of a unit rotation angle of the crank shaft. The unit rotation angle signal (hereinafter referred to as POS signal) generated from this rotation sensor 146 includes generally a train of 180 pulses appearing during each complete revolution of the crankshaft in the case of a four-cylinder engine. An $O_2$-sensor 142 is provided in the exhaust pipe 3 to sense oxygen concentration in combustion gases exhausted from the engine 25 thereby generating an electrical output signal indicative of the $O_2$-concentration of the engine exhaust gases. It is possible to determine from the detected $O_2$-concentration the ratio of air or oxygen quantity to the fuel quantity of the air-fuel mixture which has undergone the combustion to give rise to the detected $O_2$-concentration. As is well known, the level of the output signal from this $O_2$-sensor 142 varies sharply stepwise at the value of the so-called stoichiometric A/F ratio.

The output signals from the vacuum sensor 144, rotation sensor 146, engine temperature sensor 134, throttle switch 148, throttle sensor 140 and the $O_2$-sensor 142 are applied to the ECU, and on the basis of these input signals, the ECU applies control signals to the slow solenoid-operated valve 16, the main solenoid-operated valve 18, the air bypass control solenoid-operated valve 22, the fuel bypass control solenoid-operated valve 20 and pressure control valve 36. Although, not directly concerned with the present invention, the engine 25 is provided with a distributor 11 and an ignition coil 2 for controlling the ignition timing in response to an output signal from the ECU.

Figure 2:
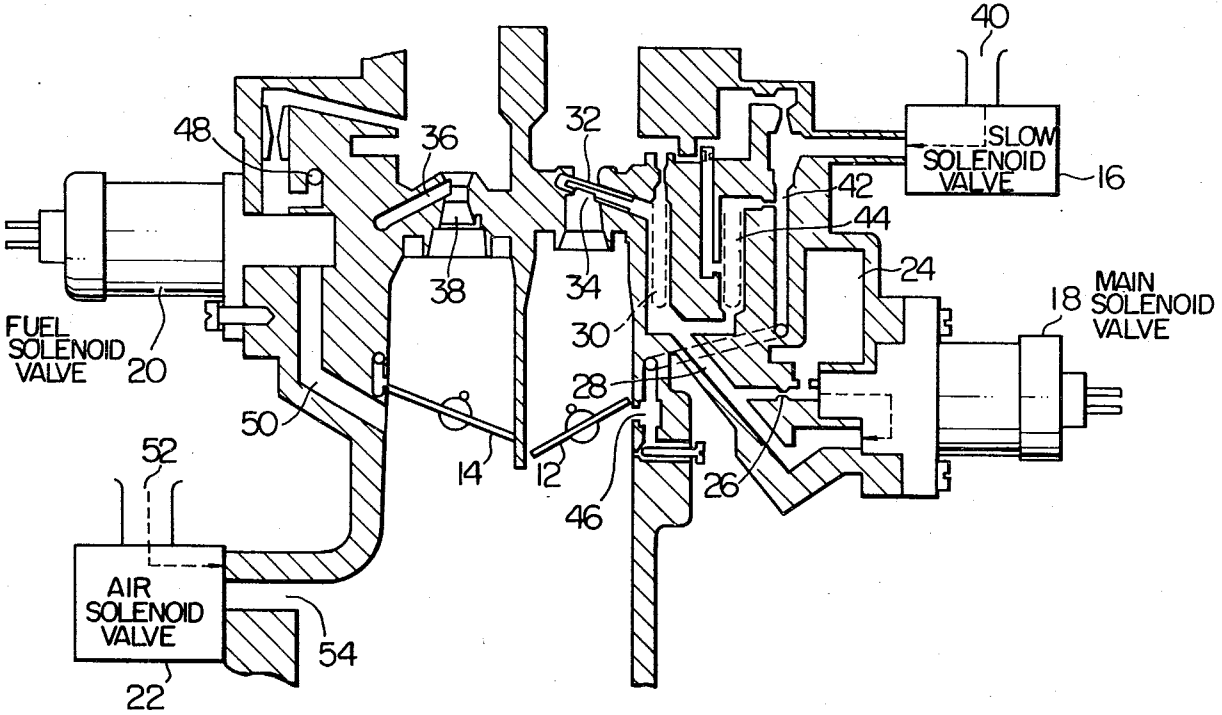
FIG. 2 shows schematically in a partial sectional view a carburetor used in the internal combustion engine shown in FIG. 1.

FIG. 2 is a sectional view showing a throttle chamber of an internal combustion engine. Various solenoid valves are provided around the throttle chamber for controlling a fuel quantity and a bypass air flow supplied to the throttle chamber, as will be described below.

Opening of a throttle valve 12 for a low speed operation is controlled by an acceleration pedal (not shown), whereby air flow supplied to individual cylinders of the engine from an air cleaner (not shown) is controlled. When the air flow passing through a Venturi 34 for the low speed operation is increased as the result of the increased opening of the throttle valve 12, a throttle valve 14 for a high speed operation is opened through a diaphragm device (not shown) in dependence on a negative pressure produced at the Venturi for the low speed operation, resulting in a decreased air flow resistance which would otherwise be increased due to the increased intake air flow.

In order to detect the quantity of air flow or quantity (mass) of oxygen fed to the engine cylinders under the control of the throttle valves 12 and 14, an analog quantity output from a negative pressure sensor (not shown) is fetched. In dependence on the analog signal thus produced as well as other signals available from other sensors which will be described hereinafter, the opening degrees of various solenoid valves 16, 18, 20 and 22 shown in FIG. 1 are controlled.

Next, description will be given of the flow of fuel being supplied. The fuel fed from a fuel tank through a conduit 24 is introduced into a conduit 28 through a main jet orifice 26. Additionally, fuel is introduced to the conduit 28 through a main solenoid valve 18. Consequently, the fuel quantity fed to the conduit 28 is increased as the opening degree of the main solenoid valve 18 is increased. Fuel is then fed to a main emulsion tube 30 to be mixed with air and supplied to the Venturi 34 through a main nozzle 32. At the time when the throttle valve 14 for high speed operation is opened, fuel is additionally fed to a Venturi 38 through a nozzle 36. On the other hand, a slow solenoid valve (or idle solenoid valve) 16 is controlled simultaneously with the main solenoid valve 18, whereby air supplied from the air cleaner is introduced into a conduit 42, through an inlet port 40. Fuel fed to the conduit 28 is also supplied to the conduit or passage 42 through a slow emulsion tube 44. Consequently, the quantity of fuel supplied to the conduit 42 is decreased as the quantity of air supplied through the slow solenoid valve 16 is increased. The mixture of air and fuel produced in the conduit 42 is then supplied to the throttle chamber through an opening 46 which is also referred to as the slow hole.

The fuel solenoid valve 20 serves to increase the fuel quantity for the engine starting and warming-up operations. Fuel introduced through a hole 48 communicating with the conduit 24 is fed to a conduit 50 communicating with the throttle chamber in dependence on the opening degree of the fuel solenoid valve 20.

The air solenoid valve 22 serves to control the air quantity supplied to the engine cylinders. To this end, the air solenoid valve 22 is supplied with air from the air cleaner through an opening 52, whereby air is introduced into a conduit 54 opening in the throttle chamber in a quantity corresponding to the opening degree of the air solenoid valve.

The slow solenoid valve 16 cooperates with the main solenoid valve 18 to control the air-fuel ratio, while the fuel solenoid valve 20 functions to increase the fuel quantity. Further, the engine speed at the idling operation is controlled through cooperation of the slow solenoid valve 16, the main solenoid valve 18 and the air solenoid valve 22.

Figure 3:
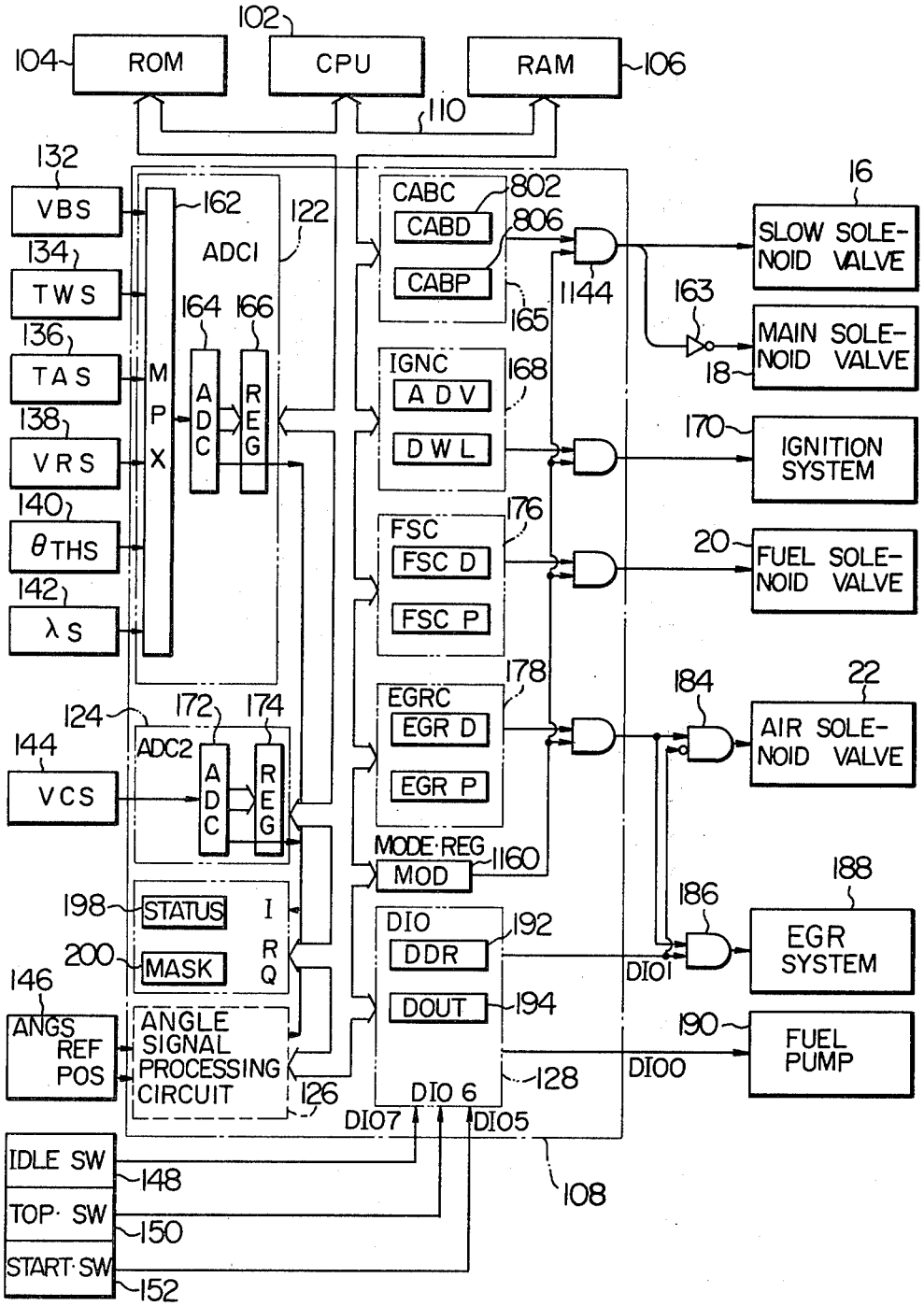
FIG. 3 is a block diagram to illustrate a general arrangement of a control system of the control apparatus shown in FIG. 1.

FIG. 3 shows a schematic diagram of the general arrangement of the overall control system shown in FIG. 1. The ECU shown in FIG. 1 includes a central processing unit (hereinafter referred to as CPU) 102, a read-only memory (hereinafter referred to as ROM) 104, a random access memory (hereinafter referred to as RAM) 106, and an input/output interface circuit 108. The CPU 102 performs arithmetic operations for input data from the input/output circuit 108 in accordance with various programs stored in ROM 104 and feeds the results of arithmetic operation back to the input/output circuit 108. Temporary data storage as required for executing the arithmetic operations is accomplished by using the RAM 106. Various data transfers or exchanges among the CPU 102, ROM 104, RAM 106 and the input/output circuit 108 are realized through a bus line 110 composed of a data bus, a control bus and an address bus.

The input/output interface circuit 108 includes input means constituted by a first analog-to-digital converter 122 (hereinafter referred to as ADC1), a second analog-to-digital converter 124 (hereinafter referred to as ADC2), an angular signal processing circuit 126, and a discrete input/output circuit 128 (hereinafter referred to as DIO) for inputting or outputting a single-bit information.

The ADC1 122 includes a multiplexer 162 (hereinafter referred to as MPX) which has input terminals applied with output signals from a battery voltage detecting sensor 132 (hereinafter referred to as VBS), a sensor 134 for detecting temperature of cooling water (hereinafter referred to as TWS), an ambient temperature sensor 136 (hereinafter referred to as TAS), a regulated-voltage generator 138 (hereinafter referred to as VRS), a sensor 140 for detecting a throttle angle (hereinafter referred to as $\theta$THS) and the $O_2$-sensor 142 (hereinafter referred to also as $\lambda$S). The multiplexer or MPX 162 selects one of the input signals to supply it to an analog-to-digital converter circuit 164 (hereinafter referred to as ADC). A digital signal output from the ADC 164 is held by a register 166 (hereinafter referred to as REG).

The output signal from a negative pressure sensor 144 (hereinafter referred to as VCS) is supplied to the input of ADC2 124 to be converted into a digital signal through an analog-to-digital converter circuit (hereinafter referred to as ADC) 172. The digital signal output from the ADC 172 is set in a register (hereinafter referred to as REG) 174.

An angle sensor 146 (hereinafter termed ANGS) is adapted to produce a signal representative of a standard or reference crank angle, e.g. of 180° (this signal will be hereinafter termed REF signal) and a signal representative of a minute crank angle (e.g. 1°) which signal will be hereinafter referred to as POS signal. Both of the signals REF and POS are applied to the angular signal processing circuit 126 to be shaped.

The discrete input/output circuit or DIO 128 has inputs connected to an idle switch 148 (hereinafter referred to as IDLE-SW), a top-gear switch 150 (hereinafter termed TOP-SW) and a starter switch 152 (hereinafter referred to as START-SW).

Next, description will be given of a pulse output circuit as well as objects or functions to be controlled on the basis of the results of arithmetic operations executed by CPU 102. An air-fuel ratio control device 165 (hereinafter referred to as CABC) serves to vary the duty cycle of a pulse signal supplied to the slow solenoid valve 16 and the main solenoid valve 18 for the control thereof. Since increasing the duty cycle of the pulse signal through control by CABC 165 involves a decrease in the fuel supply quantity through the main solenoid valve 18, the output signal from CABC is applied to the main solenoid valve 18 through an inverter 163. On the other hand, the fuel supply quantity controlled through the slow solenoid valve 16 is increased, as the duty cycle of the pulse signal produced from the CABC 165 is increased. The CABC 165 includes a register (hereinafter referred to as CABP) for setting therein the pulse repetition period of the pulse signal described above and a register (hereinafter referred to as CABD) for setting therein the duty cycle of the same pulse signal. Data for the pulse repetition period and the duty cycle to be loaded in these registers CABP and CABD are available from the CPU 102.

An ignition pulse generator circuit 168 (hereinafter referred to as IGNC) is provided with a register (hereinafter referred to as ADV) for setting therein ignition timing data and a register (hereinafter referred to as DWL) for controlling the duration of the primary current flowing through the ignition coil. Data for these controls are available from the CPU 102. The output pulse from the IGNC 168 is applied to the ignition system denoted by 170 in FIG. 4.

A fuel increasing pulse generator circuit 176 (hereinafter referred to as FSC) serves to control the duty cycle of a pulse signal applied to the fuel solenoid valve 20 shown in FIG. 1 for the control thereof and includes a register for setting therein the pulse repetition period of the pulse signal (this register will be hereinafter referred to as FSCP) and a register (hereinafter referred to as FSCD) for setting the duty cycle of the same pulse signal.

A pulse generator circuit 178 (hereinafter referred to as EGRC) for producing a pulse signal to control the quantity of exhaust gas to be recirculated (EGR) includes a register (hereinafter termed EGRP) for setting the pulse repetition period and a register (hereinafter termed EGRD) for setting the duty cycle of the pulse signal which is supplied to the air solenoid valve 22 through an AND gate 184 having the other input supplied with the output signal DI01 from the DIO 128. More specifically, when the signal DIO1 is at a level "L", and AND gate 184 is enabled to conduct therethrough the control pulse signal for controlling the air solenoid valve 22.

On the other hand, when the signal DIO1 is at a level "H", an AND gate 186 is made conductive to control the EGR system 188.

The DIO 128 is an input/output circuit for a single bit signal as described hereinbefore and includes to this end a register 192 (hereinafter referred to as DDR) for holding data to determine the output or input operation, and a register 194 (hereinafter referred to as DOUT) for holding data to be output. The DIO 128 produces an output signal DIO0 for controlling the fuel pump 190.

Figure 4:
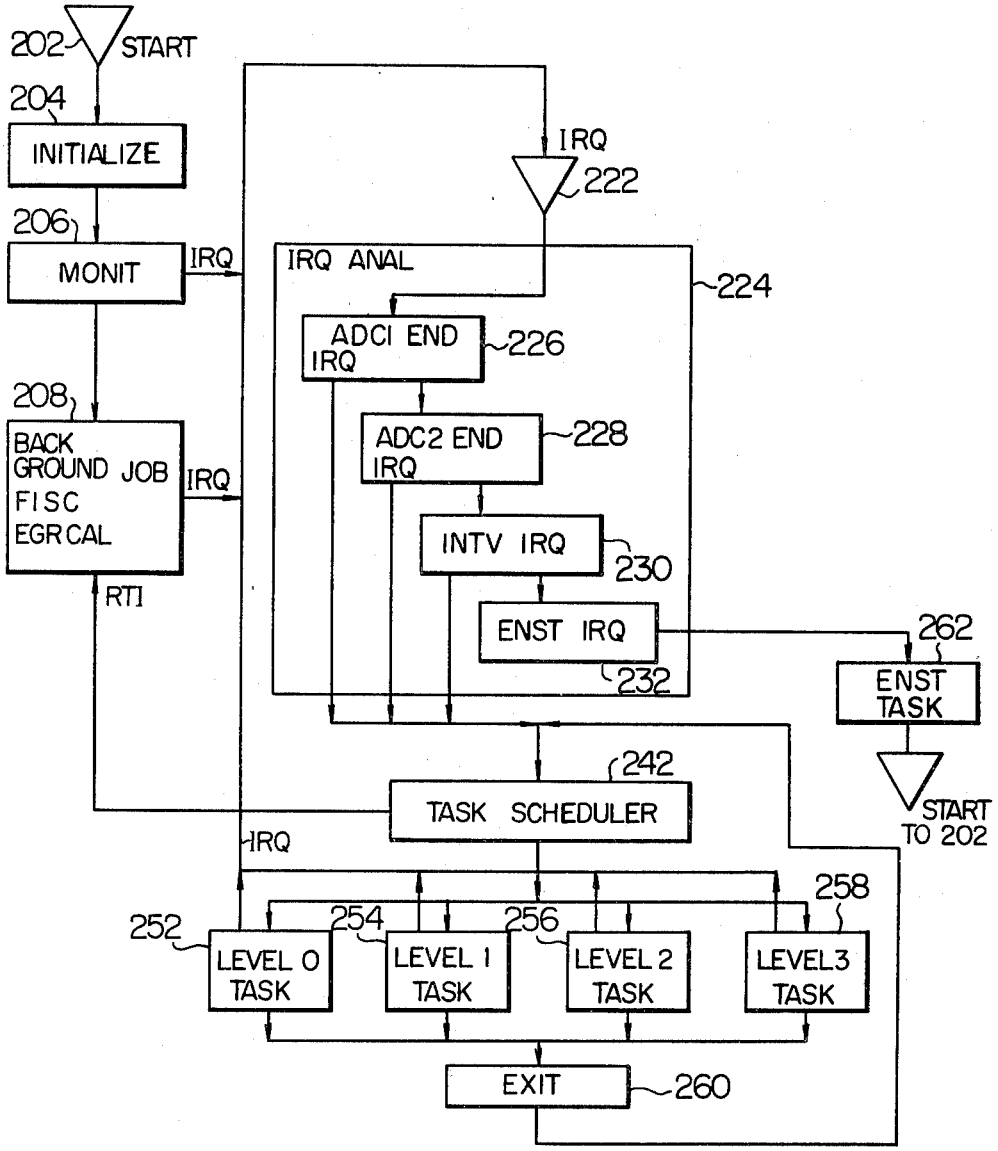
FIG. 4 is a program system diagram to illustrate specifically an OS program for the control system shown in FIG. 3.

FIG. 4 illustrates a program system for the control circuit shown in FIG. 3. When a power supply source is turned on by a key switch (not shown), the CPU 102 is set in a start mode to execute an initialization program (INITIALIZE). Subsequently, a monitor program (MONIT) 206 is executed and followed by execution of background job (BACKGROUND JOB) 208, which is initiated in response to the start of a process for converting combustion energy into mechanical energy. The background jobs include, for example, task for calculating the quantity of EGR (hereinafter referred to as ERG CAL. task) and task for calculating the control quantities for the fuel solenoid valve 20 and the air solenoid valve 22 (hereinafter referred to as FISC). When an interrupt request (hereinafter termed IRQ) occurs during the execution of these tasks, an IRQ analyzing program 224 (hereinafter termed IRQ ANAL) is executed from the start step 222. The program IRQ ANAL is constituted by an end interrupt processing program 226 for the ADC1 (hereinafter referred to as ADC1 END IRQ), an end interrupt processing program 228 for the ADC2 (hereinafter referred to as ADC2 END IRQ) and an interval interrupt processing program 230 (hereinafter referred to as INTV IRQ), and an engine stop interrupt processing program 232 (hereinafter referred to as ENST IRQ) and issues activation requests (hereinafter referred to as QUEUE) to the tasks to be activated among those described below.

The tasks to which the request QUEUE is issued from the subprograms ADC1 END IRQ 226, ADC2 END IRQ 228 and INTV IRQ 230 of the program IRQ ANAL 224 are a task group 252 of level "0", a task group 254 of level "1", a task group 256 of level "2" or a task group 258 of level "3" or alternatively given individual tasks which constitute parts of these task groups. The task to which the request QUEUE is issued from the program ENST IRQ 232 is a task program 262 for processing the stopping of the engine (this task will be hereinafter referred to as ENST TASK). When the task program ENST TASK 262 has been executed, the control program is set back to the start mode and the start step 202 is resumed.

A task scheduler 242 serves to determine the sequence in which the task groups are executed such that the task groups to which the request QUEUE is issued or execution of which is interrupted are executed starting from the task group of the highest level. In the case of the illustrated example, it is assumed that the level "0" is the highest level. Upon execution of the task group of highest level, a termination indicating program 260 (hereinafter referred to as EXIT) is executed to inform this fact to the task scheduler 242. Subsequently, the task group of the next highest level among those in the queue is executed and so forth.

When there remains no task group the execution of which is interrupted or to which the request QUEUE is issued, the execution of the background jobs 208 is resumed under the command of the task scheduler 242. Further, when IRQ is issued during execution of the task group among those of level "0" to "3", the starting step 222 of the IRQ processing program is regained.

Identifications and functions of the individual task programs are listed in Table 1.

TABLE 1

| Level | Identification of programs | Functions | Activation (Timing) |
|---|---|---|---|
| — | IRQ ANAL | Analysis of IRQ and issue of requests for activating task groups or tasks | IRQ |
| — | TASK SCHEDULER | Determination of task groups or tasks to be executed | End of IRQ ANAL or end of EXIT |
| — | EXIT | Informing of ended executions of task groups | End of individual task groups |
| 0 | AD1IN | Fetching of output from ADC1 | INTV IRQ (10 m · sec) or ADC1END |
| | AD1ST | Initiation of ADC1 | INTV IRQ (10 m · sec) |
| | AD2IN | Fetching of output from ADC2 | INTV IRQ (10 m · sec) or ADC1 END |
| | AD2ST | Initiation of ADC2 | INTV IRQ (10 m · sec) |
| | RPMIN | Fetching of engine speed | INTV IRQ (10 m · sec) |
| 1 | CARBC | Calculation of duty cycle for | INTV IRQ (20 m · sec) |

TABLE 1-continued

| Level | Identification of programs | Functions | Activation (Timing) |
|---|---|---|---|
| | | controlling air-fuel ratio | |
| | IGNCAL | Calculation of ignition timing | INTV IRQ (20 m · sec) |
| | DWLCAL | Calculation of duration of primary current through ignition coil | INTV IRQ (20 m · sec) |
| 2 | LAMBDA | Control of λ ($O_2$ feedback control) | INTV IRQ (40 m · sec) |
| 3 | HOSEI | Calculation of corrections | INTV IRQ (100 m · sec) |
| — | FISC | Calculation for positioning fuel valve and air valve | BACKGROUND JOB |
| — | EGRCAL | Calculation for positioning negative-pressure-controlled valve for EGR | BACKGROUND JOB |
| — | INITIALIZE | Setting initial values at input/output circuit | START or RE-START |
| — | MONIT | Monitoring of START-SW and starting of fuel pump | START or RE-START |
| — | ENST TASK | Stop of fuel pump and resetting of IGN | ENST IRQ |

As can be seen from the above Table 1, there are programs for monitoring or supervising the control system illustrated in FIG. 4 such as programs IRQ ANAL, TASK, SCHEDULER and EXIT. These programs (hereinafter referred to as OS programs) are held in ROM 104 at addresses A000 to A2FF, as is illustrated in FIG. 5.

As the program of level "0", there are AD1ST, AD2IN, AD2ST and RPMIN which are activated usually by INTV IRQ produced for every 10 m.sec. Programs of level "1" includes CARBC, IGNCAL and DWLCAL programs which are activated for every INTV IRQ produced periodically at time interval of 20 m.sec. As the program of level "2", there is LAMBDA (λ) i.e. a program for the feedback control by the $O_2$-sensor which is activated by INTV IRQ for every 40 m.sec. Accordingly, the program illustrated in the flow charts in FIGS. 17 and 18 will not be activated until at least 40 m.sec. has elapsed. However, when an activation request is issued to the tasks of priority level "0" or "1" higher than the level "2" allotted to the $O_2$-control, the execution of the task of level "2" is interrupted for a time longer than 40 m.sec. since the task of a higher level is executed with priority. The program of level "3" is HOSEI which is activated by INTV IRQ every 100 m.sec. The programs EGRCAL and FISC are for the background jobs. The programs of level "0" are stored in ROM 104 at addresses A600 to AAFF as PROG1, as is shown in FIG. 5. The level "1" programs are stored in ROM 104 at addresses AB00 to ADFF as PROG2. The level "2" programs are stored in ROM 104 at address AE00 to AEFF as PROG3. The program of level "3" is stored in ROM 104 at addresses AF00 to AFFF as PROG4. The program for the background jobs is held at address B000 to B1FF. A list (hereinafter referred to as SFTMR) of the start addresses of the programs PROG1 to PROG4 described above is stored at addresses B200 to B2FF, while values representative of the activation periods of the individual programs (hereinafter referred to as TTM) are stored at addresses B300 to B3FF.

Figure 5:
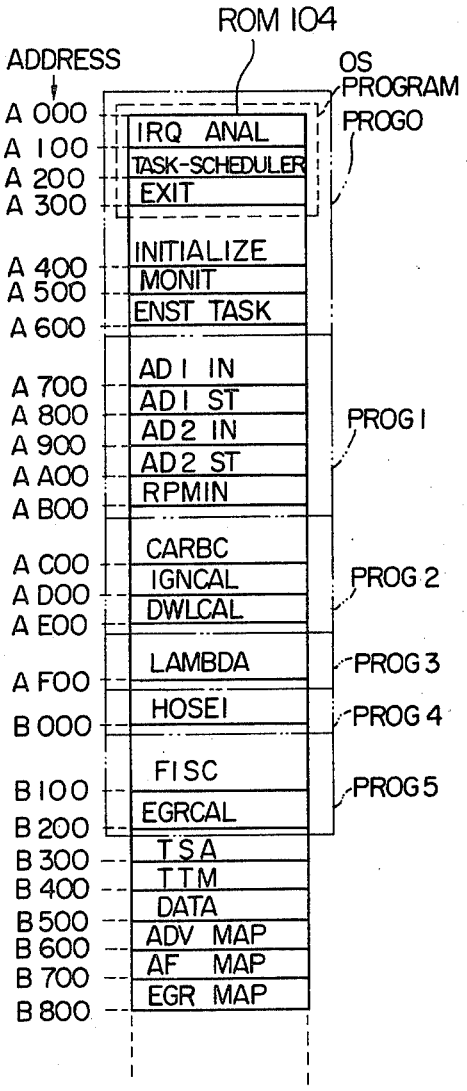
FIG. 5 shows a structure of a memory to illustrate programmed contents stored in ROM (read-only memory)

Other data as required are stored in ROM 104 at addresses B400 to B4FF, as is illustrated in FIG. 5. In succession thereto, data ADV MAP, AF MAP and EGR MAP are stored at B500 to B7FF.

Figure 6:
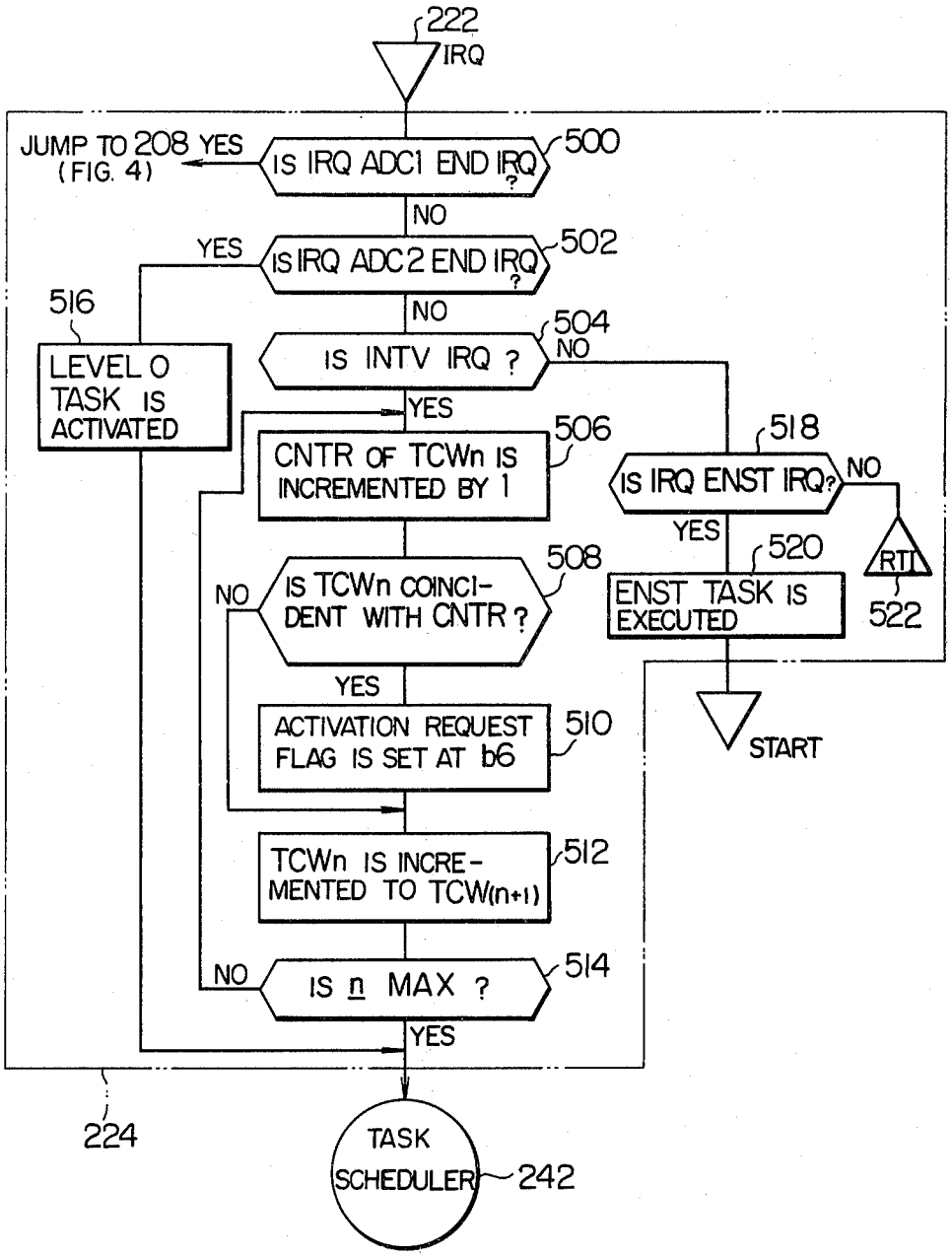
FIG. 6 illustrates in a flow chart details of a program block 224 shown in FIG. 4.
Figure 8:
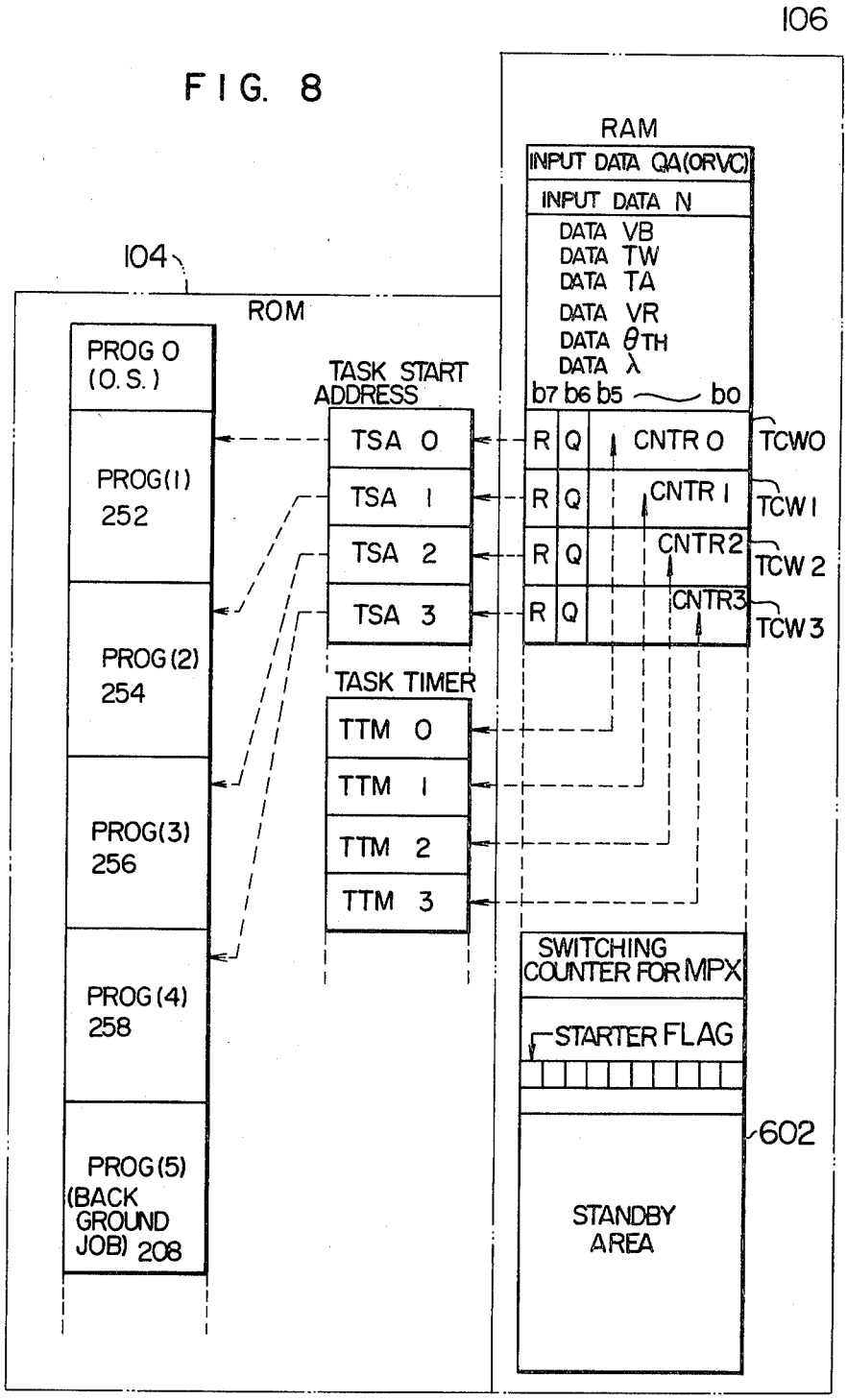
FIG. 8 is a view to illustrate an activation request generating operation for a task level program.

An example of the program 224 is illustrated in FIG. 6. This program starts from an entry step 222 and, when it is detected by a step 500 that the ADC1 END IRQ is not produced, proceeds to a step 502 at which it is decided that IRQ as issued is ADC2 END IRQ or not. If affirmative ("YES"), an activation request is issued to the program of the task level "0" at a step 516. This can be accomplished by setting a flag of "1" at b6 of a task control word TCW0 in the RAM 106 shown in FIG. 8. The program then proceeds to the TASK SCHEDULER 242. In the case of the embodiment now being described, it is assumed that ADC2 END IRQ is allowed to be generated only during the execution of the INITIALIZE program 204 shown in FIG. 4 but is otherwise inhibited. When the decision at the step 502 is "NO", the program proceeds to the step 504 at which step it is decided whether the IRQ being issued is INTV IRQ generated at a predetermined constant time interval or period. If affirmative or "YES", the program proceeds to a step 506. At the steps 506 to 514, the INTV IRQ is examined in connection with the timing for activating the programs of the task level "0" to the task level "3". A first, an examination is made as to the program of the task level "0". More specifically, the task control word of the task level "0" i.e. the counter 0 including bits b0 to b5 of TCW0 shown in FIG. 8 is incremented by "1". In this connection, it should be noted that although up-counting is adopted in the case of the illustrated embodiment, a down-counting or decrementing may be of course adopted. At the step 508, the contents of the counter 0 of TCW0 are compared with those of the task activating timer TTM0 shown in FIG. 8. Herein, the presence of "1" in TTM0 means that the program of task level "0" (denoted by 252 in FIG. 4) is activated for every 10 m. sec., since it is assumed that the INTV IRQ is generated at a period or time interval of 10 m sec. At the step 508, the contents of the counter CNTRO and the task timer TTMO are compared with each other. When coincidence is found (i.e. "YES"), the program proceeds to the step 510 at which a flag "1" is set at b6 of the task control word TCW0. In the case of the illustrated embodiment, the bits b6 of every TCW represent the flags for requesting the activation of the associated tasks. The bit positions b0 to b5 of the counter CNTRO are all cleared, because the flag "1" is set at b6 of TCW0 at the step 510.

At the step 512, retrieval of the activation timing for the program of task level "1" is effected. At a step 514, it is decided whether the task of level "3" has ended, i.e. if n=4. Since n=1 in this case, the program returns to the step 506 at which step the contents of the counter CNTR1 of TCW1 in RAM 106 shown in FIG. 8, which is the task control word for the program of task level "1" is incremented by "+1". At the step 508, the incremented contents are compared with the contents of TTM1 of ROM 104 shown in FIG. 8. In the case of the illustrated embodiment, it is assumed that the contents of TTM1 are equal to "2". In other words, the timing period for activating the program of the task level "1" is 20 m sec. Assuming now that the contents of the counter CNTR1 are equal to "1", the result of decision at the step 508 is "N0", which means that the activation timing is not for the program 254 of the task level "1". Thus, the program proceeds to the step 512 at which step the task level of the program to be retrieved is updated again to the task level "2". In a similar manner, processing operations are carried out up to the level "3", whereupon n becomes equal to 4 at the step 512. Thus, conditions n=MAX are fulfilled at the step 514. The processing operations are then transferred to the task scheduler 242.

When no INTV IRQ is found at the step 504, the program proceeds to a step 518 at which step it is decided that the IRQ in question is ENST IRQ. When the decision made at the step 504 is "NO", the IRQ must necessarily be ENST IRQ. Accordingly, the step 518 may be omitted and the program may proceed directly to the step 520, at which the fuel pump is stopped in accordance with a specific program based on the engine stop. Additionally, all the output signals for the ignition system and the fuel supply control system are reset. The program then returns to the start step 202 shown in FIG. 4.

Figure 7:
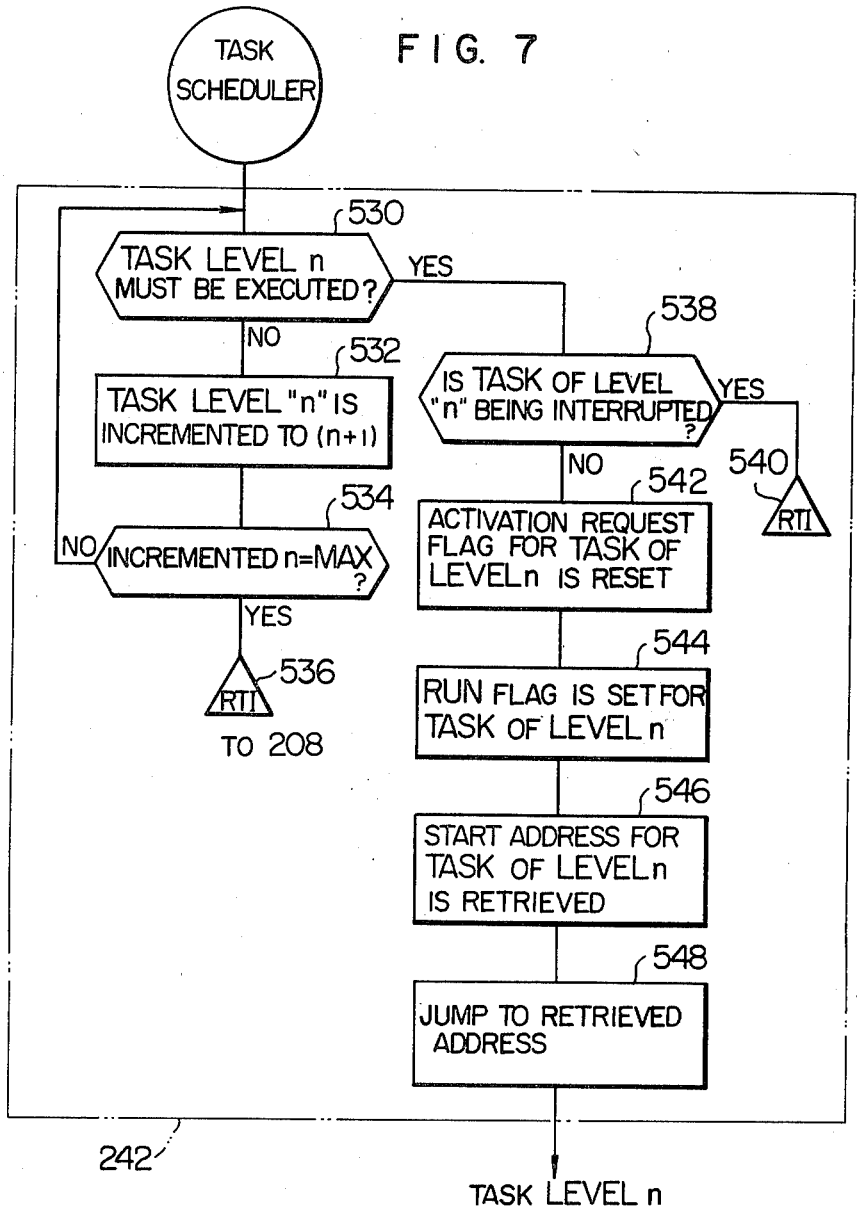
FIG. 7 illustrates in a flow chart details of a task scheduler (242) shown in FIG. 4.

FIG. 7 shows in detail in a flow chart a program for the task scheduler 242. At a step 530, it is decided whether the task of task level "n" is needed. At first, n=0. Accordingly, a decision is made as to the necessity of the task of level "0" being executed. In other words, the presence of the task activation request is examined in the order of high to low priority levels. Such an examination can be made through the retrieval of bits from b6 and b7 of the respective task control words. Bit position b6 is allotted to the activation request flag. When "1" is present at this position b6, it is determined that the activation request is present. Further, b7 is allotted for the flag indicating that the associated task is under execution. The presence of "1" at b7 indicates that the associated task is under execution and is now being interrupted. Accordingly, when "1" is present at least at one of b6 and b7, the scheduler program proceeds to the step 538.

At the step 538, the flag set at b7 is checked. The presence of "1" at b7 means that the execution is being interrupted. At a step 540, the execution which has been interrupted until then, is resumed. Flags set at both b6 and b7 cause the decision at the step 538 to be affirmative or "YES", whereby the task program being interrupted is re-initiated. In the case where "1" is present only at b6, the activation request flag of the task of the corresponding task level is cleared at the step 542, which is followed by a step 544 where the flag is set at b7 (this flag will be hereinafter referred to as RUN flag). The steps 542 and 544 show that the activation request for the task of the corresponding task level proceeds to the state in which the task is to be executed. Accordingly, at a step 546, the start address of the task program of the task level in concern is retrieved. This address can be determined from a start address table TSA provided in ROM 104 in correspondence to TCWs of the various task levels (FIG. 8). By jumping to the start address as determined, the execution of the task program in concern takes place.

Referring again to FIG. 7, when the decision at the step 530 results in "NO", this means that neither is an activation request is issued to the program of the task level being retrieved nor is the program being momentally interrupted. In this case, the scheduler program proceeds to the retrieval of the task of the next high level. In other words, the task level n is incremented to (n+1). At this time, it is determined whether the incremented level index (n+1) is maximum MAX, i.e. (n+1)=4. If not, the scheduler program proceeds to the step 530. The above processing operations are repeated until n has become equal to MAX or 4, whereupon the interrupted program for the background jobs is resumed at a step 536. In other words, it is confirmed at the step 536 that all the programs for the tasks of levels "0" to "3" are not required to be executed, whereby the operation returns to the point of the background job program at which point the program has been interrupted in response to the appearance of IRQ.

FIG. 8 illustrates the relationship between the task control words TCW and the TTM task start address table representing the task activation time intervals or periods provided in the ROM. In correspondence to the task control words TCW0 to TCW3, there are stored in ROM the task activating periods TTM0 to TTM3. For every INTV IRQ, the counters CNTR or TCW are updated successively and a flag is set at b6 of the associated TCW upon coincidence between contents of the counter and TTM for the task. When the flag is thus set, the start address of the task is retrieved from the task start address TSA. A jump is made to the retrieved start address, whereby the selected one of the programs 1 to 4 is executed. During the execution, a flag is set at b7 of the TCW in RAM 106 which corresponds to the program being executed. Thus, as long as this flag is set, it is decided that the associated program is being executed. In this way, the program for the task scheduler 242 shown in FIG. 4 is executed. As a consequence, one of the task programs 252 to 258 of the task levels "0" to "3" is executed. When IRQ is issued during the execution of the any task program, the execution is interrupted again to deal with the IRQ. Assuming that no IRQ is issued, the processing of the task being instantly executed will come to an end. Upon termination of the execution of this task, the EXIT program 260 is now executed to give an end message.

Figure 9:
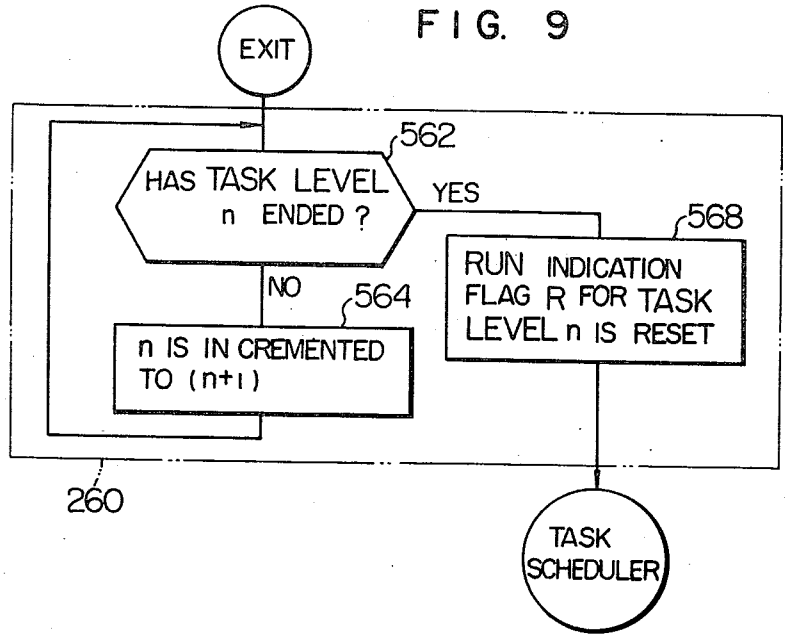
FIG. 9 is a flow chart to illustrate details of an EXIT program (260) shown in FIG. 4.

The EXIT program 260 is illustrated in detail in FIG. 9. This program is composed of steps 562 and 564 for identifying the terminated task. At the steps 562 and 564, retrieval is made successively starting from the task of level "0" to identify the task level of the ended task. At the next step 568, the flag RUN set at b7 of TCW corresponding to the terminated task is reset, which means that the program for the identified task has been completely terminated. The processing operation is resumed by the task scheduler 242, whereby the program next to be executed is determined.

Figure 10:
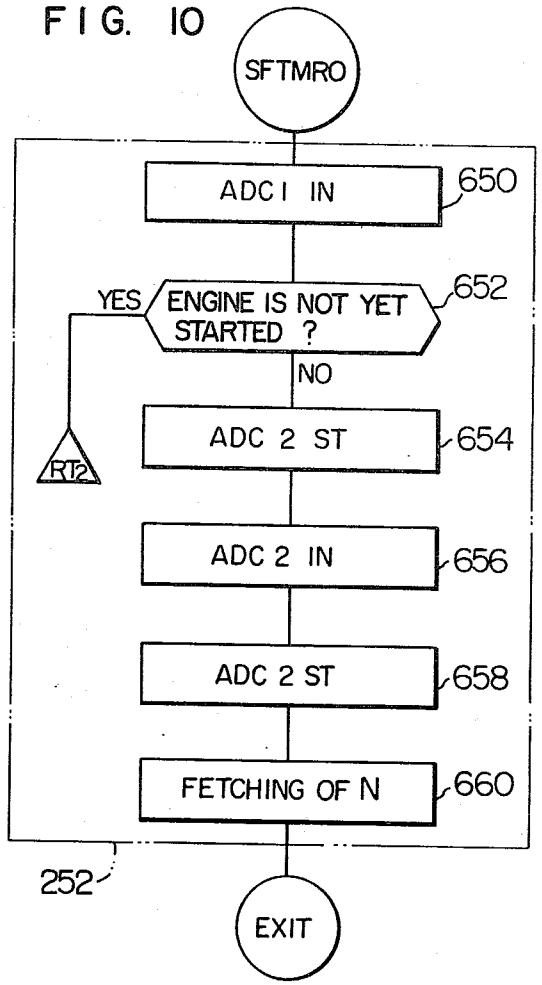
FIG. 10 is a flow chart to illustrate a program for executing a task of level 0 (block 252) shown in FIG. 4.

FIG. 10 shows a program of level "0". The activation request to this program is generated at the timing of 10 m.sec, as is shown in the Table 1. At a step 650, data of ADC1 is fetched and at a step 654 an activation request for fetching new data from ADC1 is issued. Step 652 is provided to allow ADCEND IRQ to be effected before the engine starting. When a flag indicating that the engine is not yet started is set, RTI, i.e. the program being interrupted is resumed. This program corresponds to the INITIALIZE program 204 shown in FIG. 4. At a step 656, data is fetched from ADC2. At a succeeding step 658, an activation signal is issued to fetch next data from ADC2. At a step 660, data of engine speed is fetched or sampled. When all of these steps have been processed, the subprogram EXIT of OS program is executed, to thereby clear the flag set at b7 of the associated TCW.

Figure 11:
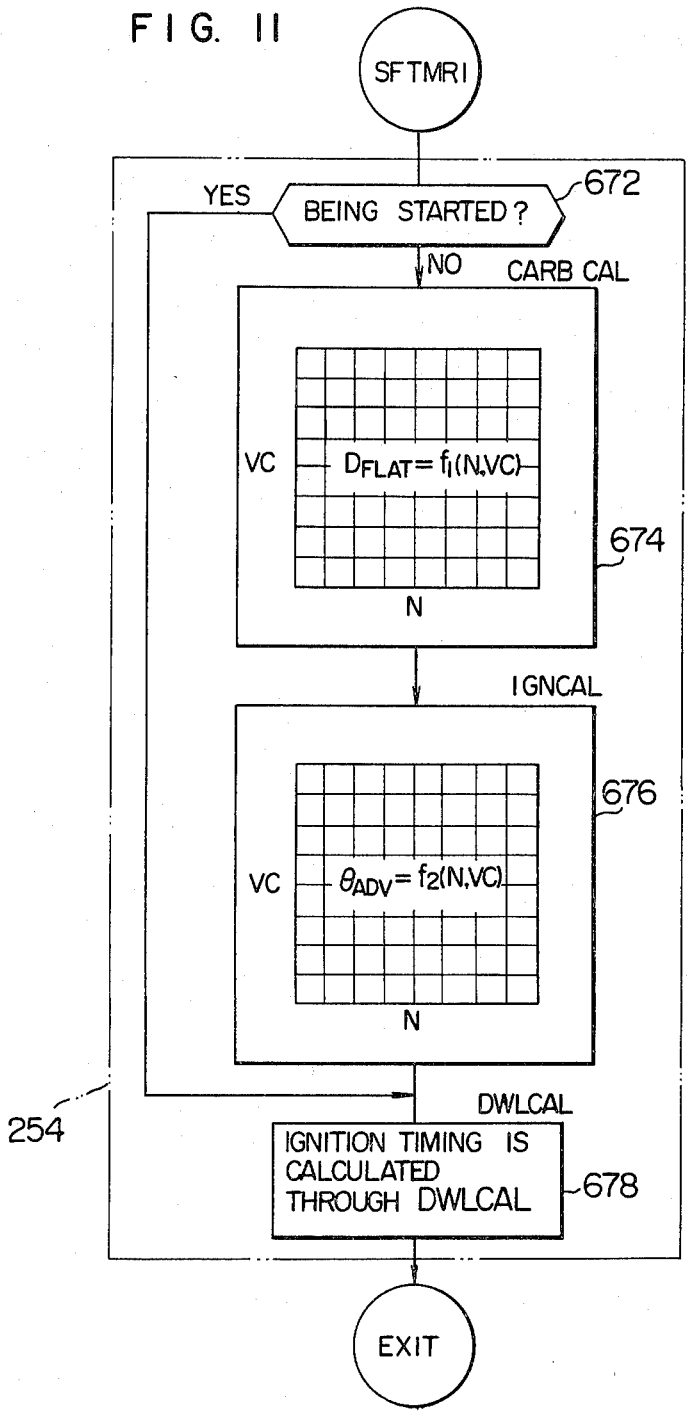
FIG. 11 is a flow chart to illustrate details of a program for executing a task of level (block 254) shown in FIG. 4.
Figure 13:
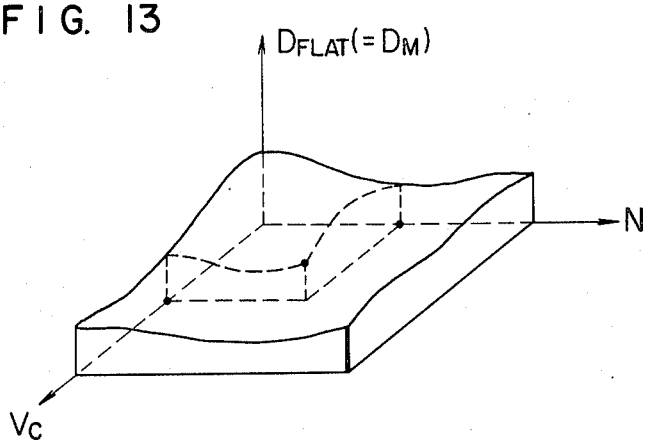
FIG. 13 shows pictorially a data map of desired duty factors of a slow solenoid valve and a main solenoid valve as a function of a negative pressure in an engine intake manifold and a revolution number of the engine.

FIG. 11 shows a program of level "1". At a step 672, it is decided whether the engine is being started. If the answer is affirmative, the program jumps to a step 678 at which the ignition timing is calculated. At a step 674, the CARBCAL program is executed. In other words, since the data $D_{FLAT}$ for controlling the valve duty factor is stored in ROM 104 as the map data ($D_M$) in correspondence to the associated parameters (i.e. number of engine revolutions N and the negative pressure VC), as shown in FIG. 13, the map data is read out and stored in the RAM 106 until a step 974 shown in FIG. 18 at which the map data $D_M$ is read out from the RAM, as will be described hereinafter. In this connection, it should be mentioned that the data is stored in the ROM digitally in a form of a matrix. Accordingly, an interpolation method is adopted for obtaining the map data $D_M$ with a high accuracy for the number of revolutions N and the pressure VC which are available in a form of analog quantity. Next, at a step 676, the IGNCAL program is executed. These program executions are effected through data retrieval from the associated tables. At the step 678, the DWLCAL program is executed to arithmetically determine the duration or current flowing time for the ignition.

LAMBDA program allotted with the task level "2" is a program for correcting λ-sensor, while the program HOSEI of level "3" is a program for determining correction factors in consideration of the atmospheric temperature, the cooling water temperature or the like. Since parameters for determining these factors have large time constants, parameters varying over a long interval may be utilized to this end.

Figure 12:
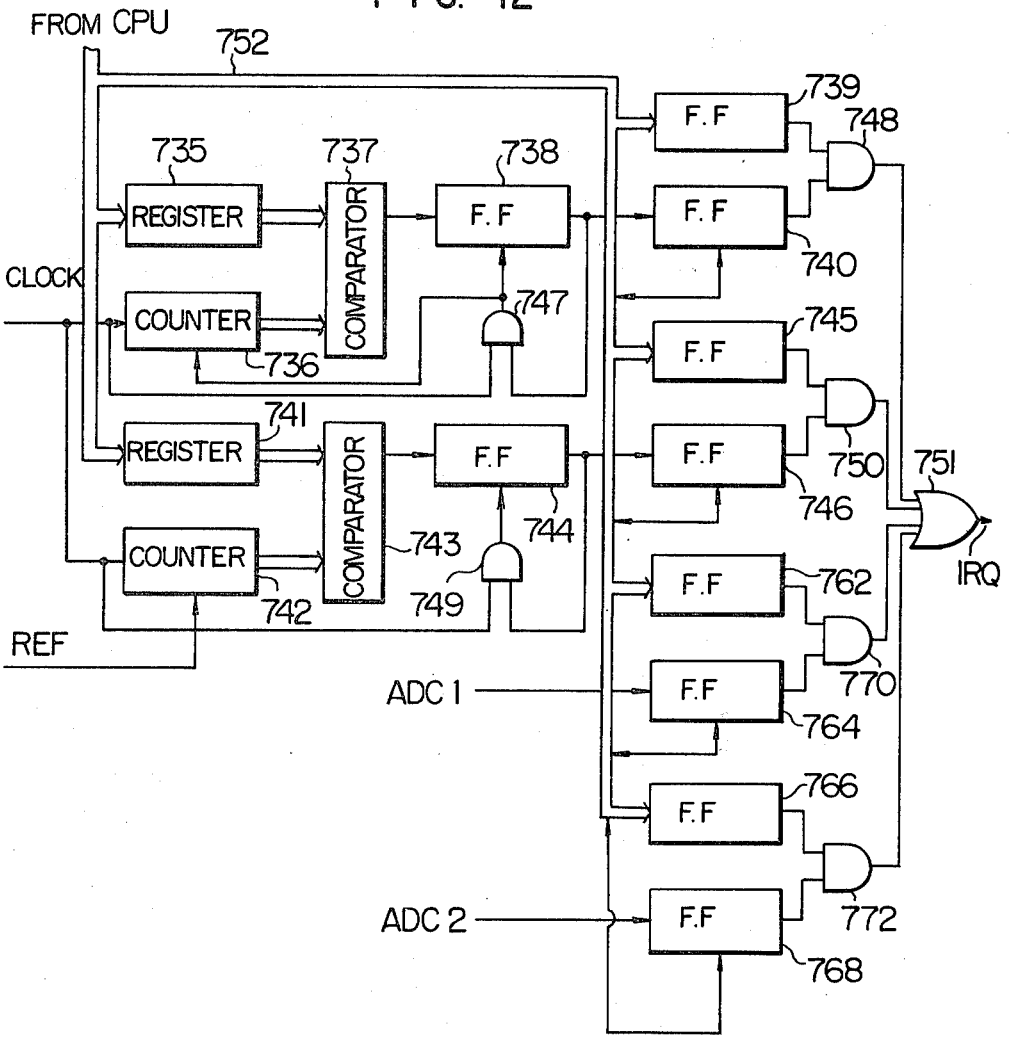
FIG. 12 is a block diagram to show a circuit arrangement of an interrupt request (IRQ) signal generating circuit used in association with the control system shown in FIG. 3.

As described hereinbefore, INTV IRQ is generated according to the teaching of this engine control system so that all the arithmetic operations for control may be carried out independently of the number of engine revolutions. An arrangement of a circuit for generating an IRQ signal is schematically shown in FIG. 12. Referring to this figure, a register 735 is loaded with data for setting the timer interrupt period (e.g. 10 m.sec) from CPU through a data bus 752, while a counter 736 is concurrently supplied with clock pulses CLOCK. The data contents placed in the register 735 are compared with the count output from the counter 736 through a comparator 737 which produces an output signal upon coincidence of the contents between the register 735 and the counter 736. The output signal from the comparator 737 is used to set flip-flops 738 and 740. Simultaneously with the setting of the flip-flops 738 and 740, an output signal is produced from AND circuit 747, whereby the counter 736 as well as the flip-flop 738 are reset. When a flip-flop 739 is set, the timer interrupt signal IRQ is produced through an AND circuit 748 and an OR circuit 751. The flip-flop 739 serves to mask the timer interrupt signal IRQ when this signal is unnecessary (e.g. when the engine is being started). At that time, the flip-flop 739 is supplied with a reset command from the CPU. On the other hand, an ENST interrupt request which is to be generated when the engine is stopped accidentally or due to fault is produced through a similar circuit arrangement as that for the timer interrupt, which comprises a register 741, a counter 742, a comparator 743, AND circuits 749 and 750, and flip-flops 745 and 746. The signal supplied to the counter 742 is however the one generated during rotation of the engine. This signal is the reference angular signal REF produced from the sensor 146 shown in FIG. 3 and may be produced for every rotation of 180° of the crank shaft in the case of a four-cylinder internal combustion engine. Since the counter 742 is reset when the signal REF is produced, no ENST interrupt signal can be generated. However, when the engine is stopped for the reasons described above, the REF signal will disappear, whereby the counter 742 is released from the reset state. Thus, the ENST interrupt signal can be generated in the manner described above in conjunction with generation of the timer interrupt signal.

The timer interrupt signal IRQ triggers the activation of tasks as illustrated in the block diagram of FIG. 4, whereby the tasks are processed in accordance with the allotted priority levels. Namely, upon reception of an interrupt request, the CPU analyses the cause for the received interrupt request. When the interrupt request is determined to be the timer interrupt, the tasks 252, 254, 256 and 258 allotted with priority levels are activated and the task selected through the task scheduler 242 is executed. When the execution of task is terminated, a corresponding indication is made through the execution of the EXIT program. In response to the next timer interrupt signal, the task next to be executed is selected through the task scheduler.

Upon the appearance of the ENST interrupt signal, the fuel pump as well as the ignition system are turned off. All the input/output control circuits are disabled.

In a similar manner, upon the occurrence of ADC1 END IRQ or ADC2 END IRQ, a flip-flop 764 is set to "1", when the sequence operation of ADC1 has been terminated. When a flip-flop 762 is set to "1" from CPU through the bus 752, an AND gate 770 is then enabled to produce a service request signal to CPU for dealing with ADC1 END IRQ. However, when the flip-flop 762 is not set to "1", ADC1 END IRQ is inhibited. The same applies to ADC2. Upon the termination of the sequence operation of ADC2, the flip-flop 768 is set to "1". When a flip-flop 766 is set to "1" at that time, ADC2 END IRQ is generated through an AND gate 772 and the OR gate 751. On the other hand, unless the flip-flop 766 is set to "1", the AND gate 772 remains disabled, resulting in no ADC2 END IRQ of being generated. In this manner, only when the flip-flop 739, 745, 762 and/or 766 is set to "1", is an associated IRQ issued and vice versa.

As listed in the Table 1, the priorities of programs are determined in dependence on the functions of the programs, wherein interval activation requests are issued in accordance with the priority. In this manner, main tasks for controlling engine operations are activated at predetermined intervals independently from rotation speed of the engine. Accordingly, the load imposed on the CPU may remain substantially constant to assure controls with high reliability and performances.

FIG. 13 shows pictorially the desired valve duty factors $D_{FLAT}$ of the solenoid valves which are stored in the ROM 104 in the form of data table.

Figure 14:
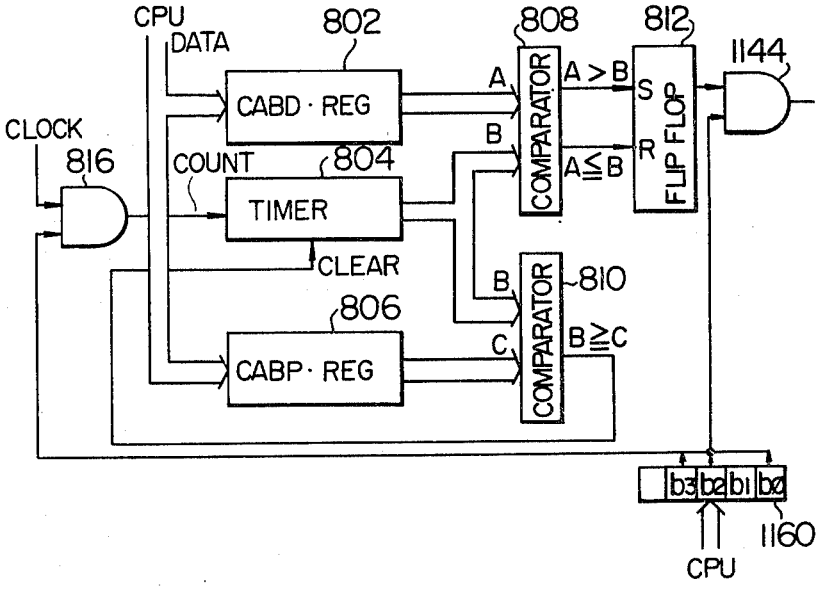
FIG. 14 shows in a block diagram circuit an arrangement for a CABC register and a CABP register shown in FIG. 3.

FIG. 14 shows in a block diagram details of the CABC register 165 shown in FIG. 3. In FIG. 14, the register 802 corresponds to the CABD register shown in FIG. 3 and serves for storing therein the data of duty factors D of the solenoid valves (i.e. data of the pulse width). The CABP register shown in FIG. 3 corresponds to a register 806 shown in FIG. 14.

It is assumed now that a bit "H" is set at a bit position b0 in a MODE register 1160. Then, both AND gates 1144 (FIG. 3) and 816 are enabled. A timer 804 constituted by a counter circuit counts the clock signals from the AND gate 816. The count value B is compared with the contents placed in the register 806 through a comparator 810. When the count value B is increased beyond the value C stored in the register 806, the timer 804 is reset. In this manner, the timer 804 repeats the counting operation at a period determined by the value C stored in the register 806.

The count value of the timer 804 is compared with the value stored in the register 802 through a comparator 808. When the count value B of the timer counter 804 is smaller than the value A set at the register 802, a flip-flop 812 is set. On the other hand, when the value B is greater than A, the flip-flop 812 is reset. In this manner, the time interval during which the flip-flop 812 is in the set state is determined by the value A stored in the register 802. By increasing the value A, the duration of the set state of the flip-flop 812 is correspondingly increased.

Since the counting operation of the timer 804 is repeated at a frequency corresponding to the value set at the register 806, the set output of the flip-flop 812 is repeatedly produced at a frequency corresponding to the value set at the register 806 and is output through the AND gate 1144 enabled by the bit of level "H" at b0 of the MODE register 1160 (FIG. 3).

When the bit at the bit position b0 of the MODE register 1160 is set at level "L", the AND gates 1144 and 816 are disabled or blocked, whereby the output from the flip-flop 812 is interrupted and at the same time the input to the timer 804 is also interrupted.

Figure 15:
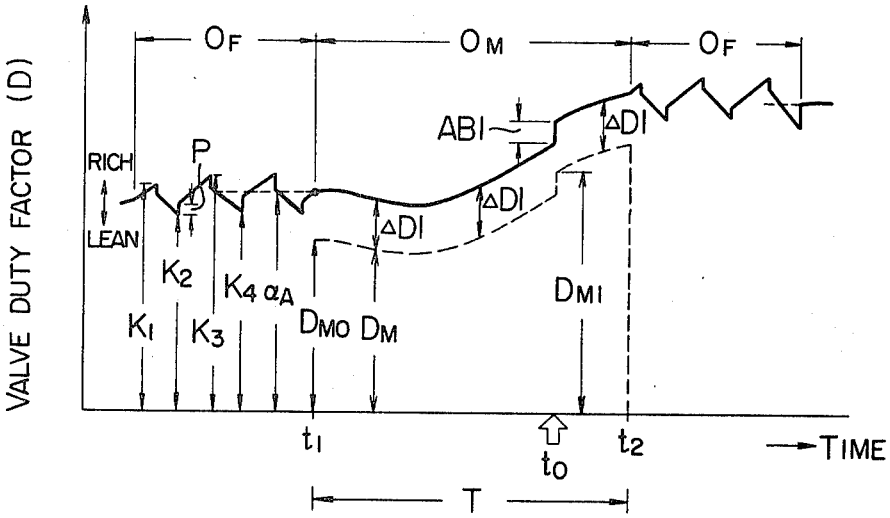
FIG. 15 graphically illustrates the principle of the invention by giving an example of a case where engine operating state undergoes relatively small variations during the map control.
Figure 16:
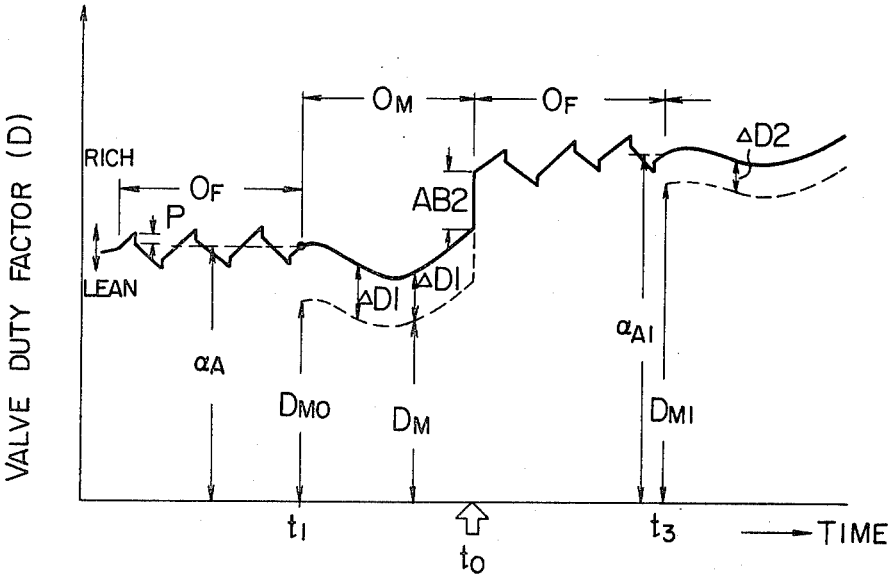
FIG. 16 is to graphically illustrate the principle of the invention for a case in which the engine operating state undergoes a relatively great variations during the map control.

FIGS. 15 and 16 illustrate graphically the principle of the present invention. In FIG. 15, the time span or period during which the $O_2$-feedback control (i.e. feedback control on the basis of the output from the $O_2$-sensor) is effected for controlling the duty factors D of the slow solenoid valve and the main solenoid valve is represented by $O_F$, while the period during which the duty factors D of these valves are controlled through the map control in the open feedback loop is represented by $O_M$. The $O_2$-feedback control is interrupted, when the number of changes in the control direction i.e. toward the RICH direction in which the air-fuel mixture is enriched from the LEAN direction in which the air-fuel mixture is rendered leaner and vice versa, has attained a predetermined value. More specifically, when a predetermined number of crests and valleys have occurred in the valve duty factor curve shown in the figure, then the $O_2$-feedback control is interrupted, i.e. the period $O_F$ is terminated. The number of changes in the control direction is determined so that the correcting quantity can be established with a high accuracy on the basis of the output from the $O_2$-sensor. The waveform of the curve representing a variation in the valve duty factor D during the $O_2$-feedback control period $O_F$ is obtained by integrating the output from the $O_2$-sensor by a proportional plus integral controller in a manner disclosed in U.S. Pat. No. 4,056,932. Upon the interruption of the $O_2$-feedback control at a time point $t_1$, the control is transferred to the map control mode represented by the succeeding period $O_M$ for open loop control. In this connection, it should be noted that when the difference $\Delta D_1$ is present at the time point $t_1$ between a value $D_{MO}$ read out from the data map (refer to FIG. 13) in correspondence with the engine operating conditions (i.e. parameters such as engine speed, negative pressure in the intake manifold and so forth) and the mean value $\alpha_A$ of the control quantity immediately before the termination of the $O_2$-feedback control phase $O_F$, the air-fuel ratio is controlled on the basis of a value obtained by adding the difference $\Delta D_1$ to the values $D_M$ successively read out from the data map. The map control mode, i.e. the $O_M$ control mode, is effected for a predetermined time interval T, e.g. 30 sec. or 60 sec. When an abrupt change in the engine operating condition of a magnitude AB1 smaller than a predetermined value takes place during the map control mode at a time point $t_0$, for example, the value read out from the data map becomes a corresponding magnitude $D_{M1}$. After the predetermined time interval T has elapsed, the map control mode $O_M$ is changed over again to the $O_2$-feedback control mode $O_F$. The length of the time interval T is previously determined so that a decision can be made as to whether the correcting quantity $\Delta D_1$ determined from the exhaust gas state described hereinbefore should be updated or not.

FIG. 16 illustrates a control procedure similar to the one illustrated in FIG. 15 except that an abrupt change in the engine operating condition takes place with a magnitude AB2 greater than the predetermined value. This change AB2 may be employed as a criterion for deciding whether the correcting quantity $\Delta D_1$ has to be newly determined. More particularly, when an abrupt change of a large magnitude AB2 occurs at a time point $t_0$ before the predetermined time duration T from the time point $t_1$ has elapsed, then the $O_2$-feedback control mode $O_F$ is immediately initiated at that time point $t_0$. Subsequently, from a time point $t_3$ at which the number of changes in the control direction has attained the predetermined value, the valve duty factor D is controlled to a value equal to the value $D_{M1}$ read out from the data map plus the difference $\Delta D_2$ thereof relative of the mean value $\alpha_{A1}$ of the immediately preceding $O_2$-feedback control quantity. In this manner, the air-fuel ratio is controlled.

Next, an example of the air-fuel ratio control method according to the invention will be described by referring to FIGS. 17 to 19 (A) and (B). At first, referring to FIG. 17, a routine comprising steps 902 to 916, inclusive, is provided for checking whether the feedback control on the basis of the output from the $O_2$-sensor (i.e. $O_2$-feedback control) is to be performed or not. At the step 902, it is determined whether the feedback loop is closed or not. In other words, it is determined whether a closed loop flag has been set at a predetermined area of RAM 106 shown in FIG. 8 at a step 912 described hereinafter. At the step 904, it is determined whether the coolant water temperature is higher than 40° C. At the step 906, it is determined whether the engine has been running for only a short time. With this determination, it is intended to ascertain whether the $O_2$-sensor has attained a temperature suited for operation thereof. In the case where the engine has been started only momentarily, a WAIT counter is set at a step 908 to initiate a time counting. Otherwise, it is determined at a step 910 whether the WAIT counter is in operation. In this manner, when it is decided that the closed loop flag has not yet been set, with the cooling water temperature being at a low level, then an appropriate control quantity predetermined to be used for such an engine operating condition is read out from the data map and loaded into the CABD register 165, whereby the slow solenoid valve 16 and the main solenoid valve 18 are controlled on the basis of the quantity thus read out from the data map.

Next, when it is confirmed at the step 910 that the time counting operation of the WAIT counter has come to an end, a determination is made as to whether the output signal from the $O_2$-sensor 142 has exceeded the predetermined value, that is, whether the $O_2$-sensor is warmed-up and activated. When the $O_2$-sensor has been adequately warmed-up, the closed loop flag is set at the predetermined area of the RAM 106 at a step 916, which is followed by the initiation of the $O_2$-feedback control.

Figure 18:
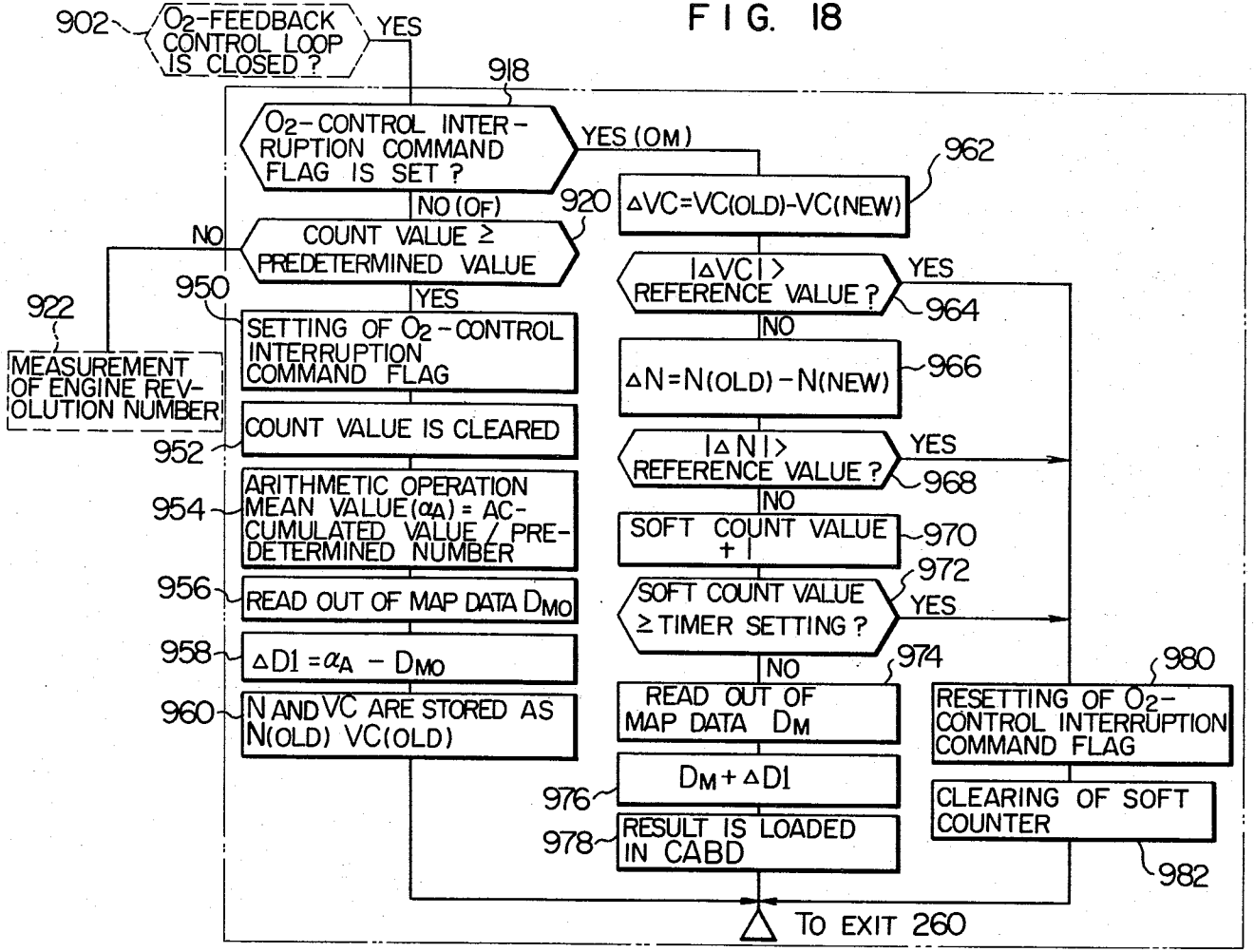

When the closed loop for the $O_2$-feedback control has been established, the program proceeds to the routine illustrated in the flow chart of FIG. 18. Referring to this figure, when it is decided at a step 918 that a flag has not been set for commanding the interruption of the $O_2$-feedback control, i.e. the interruption corresponding to the condition that the map control (OM control) is to be executed, the routine proceeds to a step 920 where a count value representative of the number of the crests or bottoms of the valve duty factor curve counted in the course of the $O_2$-control is compared with the predetermined constant value described hereinbefore. Unless the counted number has yet attained the predetermined value, the speed (N) of the engine is read out from the circuit 126 shown in FIG. 3. Referring to FIG. 17, at a step 924, a control gain value for the integrator of porportional plus integral control action is read out from the data map stored in the ROM in accordance with the number of engine revolutions (or engine speed) N. The data map stored in the ROM contains gains for the integrator which are proportional to the number of engine revolutions N. The map data read out is held in the RAM at a predetermined area. At a step 926, the output from the $O_2$-sensor is compared with a predetermined reference value, as described hereinbefore. When the air-fuel ratio derived from the output from the $O_2$-sensor 142 is found to correspond to the LEAN state (i.e. a lean air-fuel mixture), it is then determined at a step 928 whether the LEAN state has been transformed from the RICH state (i.e. an enriched air-fuel mixture). If affirmative, the peak values $K_1$, $K_2$, $K_3$, $K_4$, . . . (refer to FIG. 15) are accumulated with the aid of the RAM. The value obtained from the accumulation of the peak (crest and bottom) values in a predetermined number corresponds to an accumulated value described hereinafter in conjunction with a step 954 (FIG. 18). Subsequently, at a step 932, the count value (i.e. the number of peaks K as counted until then) is incremented by one unit or "1".

Next, at a step 934, a proportional part P is added. With the phrase "proportional part", it is intended to mean a magnitude of a rise-up in the leading and the trailing edges of the integrated waveforms of the signal available from the output of $O_2$-sensor (refer to FIGS. 15, 16 and 19(A)). The resulted sum thus obtained is set at the CABD register (FIG. 3) as the valve duty factor D at a step 936 to be utilized for controlling the slow solenoid valve and the main solenoid valve.

When it is determined at the step 928 that transition is made from a less lean state to a more lean state of the air-fuel mixture, then the integral part which is defined by the value of gain determined at the step 924 is added at a step 938.

When such a determination is made at the step 926 that the current air-fuel ratio brings about an enriched air-fuel mixture, then it is determined at a step 940 whether the "RICH" state has been preceded by the "LEAN" state or not in the same manner as in the case of the step 928. If the answer is affirmative or "YES", an accumulation of the peak values $K_1$, $K_3$, . . . is made at a step 942 which is followed by a step 944 where the count value is incremented by "1" as in the case of the step 932. At a next step 946, the proportional part P is subtracted, the resulting difference being set at the CABD register 802 (FIG. 3). On the other hand, when the decision at the step 940 is such that the current "RICH" state is a transition from the preceding more "RICH" state, a subtraction of the integral part is executed at a step 948.

In this manner, the air-fuel ratio control (i.e. $O_2$-control) is performed in correspondence to the output from the $O_2$-sensor in the routine including the steps 926 to 948.

When the count value (i.e. the number of the peaks as counted) has attained the predetermined value described hereinbefore, the $O_2$-control interrupt command flag is set in step 950 at a predetermined area in the RAM 106, which is followed by the step 952 where the current count value is cleared. At a step 954, the mean value $\alpha_A$ of the fuel control quantities used during the $O_2$-control period is arithmetically determined. The mean value $\alpha_A$ is an arithmetic mean value obtained by dividing the total sum of the peak values by a predetermined number of peak appearances. As described hereinbefore, the valve duty factor $D_M$ read out from the data map stored in the ROM in accordance with the parameters N and VC at the step 674 (FIG. 11) is held in the RAM at the predetermined area thereof. At a step 956, the value (map data $D_{MO}$) stored in the RAM is read out. Subsequently, at step 958 the difference $\Delta D_1$ between the mean value $\alpha_A$ and the map data $D_{MO}$ is arithmetically determined. At a step 960, values of the number of engine revolutions N and the negative pressure VC taken into consideration upon determination of the difference $\Delta D_1$ are stored in the RAM as the respective preceding values N (old) and VC (old) which are to serve as reference values for detecting abrupt changes in the number of engine revolutions (N) and the negative pressure (VC). Thereafter, the program returns to the task scheduler 242 through the EXIT task as described hereinbefore in conjunction with FIG. 4. Restoration of the step 900 (FIG. 16) will require a time lapse of at least 40 m.sec. If it is found through the execution of the task scheduler 242 that a task allotted with a higher priority than the level "2" at which the $O_2$-control is to be performed is present, then the task of the higher priority is executed. Accordingly, there may possibly arise a case in which the execution of the step 900 requires a time elapse of longer than 40 m.sec.

When the $O_2$-control interrupt flag is set, the steps 962 to 978 are executed. In other words, the map control is executed. These steps 962 to 978 are to allow the data map control ($O_M$) to be sustained for a predetermined time duration (a time span set by a timer), unless abrupt or significant changes occur in the number of engine revolutions and the negative pressure. A change $\Delta VC$ in the negative pressure is arithmetically determined at the step 962 and compared with a predetermined reference value at the following step 964. In other words, it is determined at the step 964 whether the change $\Delta VC$ is of a significant magnitude or not. In a similar manner, a determination is made as to the number of engine revolutions N at the steps 966 and 968. At the step 970, the count value of the software counter is incremented by "1". At the step 972, the incremented count value is compared with a predetermined value set at a software timer. When the count value is smaller than the preset value, that is, if the map control has not yet been performed for the predetermined time, the map data $D_M$ is read out at the step 974 and arithmetic operation for $(D_M+\Delta D_1)$ is executed at the step 976 in a similar manner as described hereinbefore in conjunction with the step 956. The result of the arithmetic operation is loaded in the CABD register 802 (FIG. 3) at the step 978 which corresponds to the step 936 described above.

An abrupt significant change appearing in the negative pressure or the number of engine revolutions in the course of the map control is detected at the step 964 or 966, resulting in the resetting of the $O_2$-control interrupt flag at the step 980 and the clearing of the count value in the software counter at the step 982. The same procedure takes place upon the elapse of the predetermined time set by the software timer at the step 972.

Figure 19:
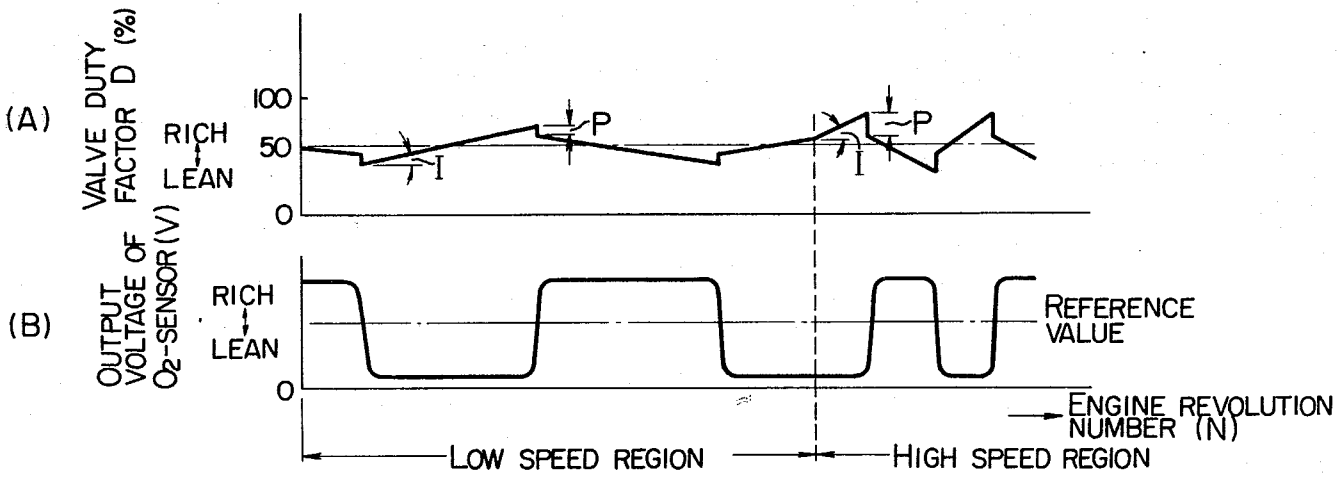
FIG. 19 graphically illustrates changes in the valve duty factor and the output from the $O_2$-sensor during the $O_2$-control in conjunction with FIG. 17.

FIGS. 19(A) and (B) illustrate the $O_2$-control operation. At the very moment the output from the $O_2$-sensor 142 exceeds a reference value, the time delay in the control system is compensated by changing the duty factor D abruptly by the proportional part P in the opposite direction. Thereafter, the valve duty factor D will vary at a constant rate I (a ratio corresponding to the gain of the integrator) until the output from the $O_2$-sensor has exceeded again the reference value. Through a repetition of these operations, the $O_2$-control for maintaining the air-fuel ratio at a predetermined value is performed. As can be seen from FIG. 19, in a region where the number of engine revolutions is high, the gain of the integrator is increased, as a result of which the proportional part P as well as the rate I (i.e. integral part) is also increased correspondingly.

What we claim is:

1. In an air-fuel ratio control system for an internal combustion engine which includes a plurality of sensors for detecting operating conditions of said engine, an oxygen sensor for detecting oxygen concentration in the exhaust gas from said engine, actuator means for supplying fuel to said engine, central processing means for executing digital operations, random access memory means for storing outputs from said central processing means, read-only memory means adapted to cooperate with said random access memory means, and input/output means coupled to said plurality of sensors for fetching data concerning the operating conditions of said engine detected by said sensors and supplying said data to said central processing means on one hand and on the other hand adapted to receive output signals from said central processing means and supply engine control signals to said actuator means; improvement residing in a method for controlling said air-fuel ratio to be effectively maintained at a desired air-fuel ratio of $\lambda=1$, comprising:

a step of performing a feedback control for maintaining said air-fuel ratio effectively maintained at a desired air-fuel ratio of $\lambda=1$ on the basis of the output from said oxygen sensor in response to the absence of a set signal for commanding interruption of said feedback control at a predetermined area in said random access memory means;

a step of performing a map control for maintaining said air-fuel ratio to be effectively maintained at a desired air-fuel ratio of $\lambda=1$ on the basis of map data read out from said read-only memory means in which said map data has been previously stored in correspondence to operation parameters of said engine, when said set signal is set at said area of said random access memory means;

a first step for clearing the set state of said set signal in response to a significant change in the engine operation appearing during said map control period; and a second step for setting said set signal.

2. A method according to claim 1, wherein said map control includes a step for reading out a first map data from said map data stored in said read-only memory means, said first map data corresponding to engine operation parameters at an instant when said feedback control is changed over to said map control, a step for arithmetically determining a correcting quantity dependently on the fuel control quantity during said feedback control period, a step of arithmetically determining a new fuel control quantity from said correcting quantity and a second map data corresponding to engine operation parameters during said map control period, a step of setting said new control quantity at said input/output means, and steps of allowing said map control to be continued for a predetermined time unless the significant change occurs in the engine operating conditions in the course of said map control.

3. A method according to claim 2, wherein said step of arithmetically determining said correcting quantity includes arithmetic operations for determining a mean fuel control quantity during said feedback control and determining a difference between said mean fuel control quantity and said first map data.

4. A method according to claim 1, wherein said first step includes sub-steps of arithmetically determining a change in suction pressure, comparing said change with an associated reference value, arithmetically determining a change in the number of engine revolutions, comparing said change of the number of engine revolutions with an associated reference value, and changing said set signal to one state from the other when said change in the suction pressure is greater than said associated reference value and when said change of said number of engine revolutions is greater than said associated reference value.

5. A method according to claim 1, wherein said second step includes sub-steps of counting the number of occurrences of changes in the fuel control quantity in the course of said feedback control, comparing the counted value with an associated predetermined number, and setting said interruption signal when said counted value has attained said predetermined number.

6. A method according to claim 1, wherein said feedback control step comprises sub-steps of comparing the output from said oxygen sensor with a reference value, adding an integral part for increasing the fuel control quantity when the output from said oxygen sensor is smaller than said reference value, and subtracting the integral part for decreasing said fuel control quantity when the output from said oxygen sensor is higher than said reference value.

7. In an air-fuel ratio control system for an internal combustion engine which includes a plurality of sensors for detecting operating conditions of said engine, an oxygen sensor for detecting oxygen concentration in the exhaust gas from said engine, actuator means for supplying fuel to said engine, central processing means for executing digital operations, random access memory means for storing outputs from said central processing means, read only memory means adapted to cooperate with said random access memory means, and input/output means coupled to said plurality of sensors for fetching data concerning the operating conditions of said engine detected by said sensors and supplying said data to said central processing means on one hand and on the other hand adapted to receive output signals from said central processing means and supply engine control signals to said actuator means;

a method for controlling said air-fuel ratio to be effectively maintained at a desired air-fuel ratio of $\lambda=1$ comprising:

a step of performing a feedback control for controlling said air-fuel ratio to be effectively maintained at a desired air-fuel ratio of $\lambda=1$ on the basis of the output from said oxygen sensor in response to the absence of a set signal for commanding interruption of said feedback control at a predetermined area in said random access memory;

a step of performing a map control for controlling the air-fuel ratio to be effectively maintained at a desired air-fuel ratio of $\lambda=1$ by reading the map data stored previously in said read-only memory means as the air-fuel ratio control data corresponding to said engine operation parameters in response to the presence of said set signal at said predetermined area of said random access memory means, said step including a sub-step of reading out a first map data from said read-only memory means, said map data corresponding to the engine operation parameters at a time point when said feedback control is changed over to said map control, a sub-step of arithmetically determining a correcting quantity which depends on the fuel control quantity during said feedback control period, a sub-step for arithmetically determining a new fuel control quantity from said correcting quantity and a second map data which correspond to the engine operation parameters during the map control period, a sub-step of setting said new correcting quantity in said input/output means, and sub-steps for allowing said map control to be continued for a predetermined time duration unless a significant change occurs in the engine operating conditions during said map control:

a second step of clearing the set state of said set signal in dependence on the magnitude of the change in said engine operating conditions occurring in the course of said map control, said second step including a sub-step of arithmetically determining a change in the suction pressure, a sub-step of comparing said change with a reference value, a sub-step of arithmetically determining a change in the number of revolutions of said engine, and a sub-step of changing over the state of said set signal from one to the other when said change in the suction pressure is greater than the associated reference value and when said value in the number of engine revolutions is greater than the associated reference value; and steps of counting number of occurrences of changes in the fuel control quantity in the course of said feedback control;

a step of comparing a count value obtained through said counting step with a predetermined number; and a step of setting said set signal when said count value has attained a predetermined number.

8. A method of operating a processor-controlled apparatus for controlling the operation of an internal combustion engine having an air-fuel mixture supply system for supplying an air-fuel mixture to said engine, and an exhaust sensor for sensing a prescribed characteristic of exhaust gas emitted from said engine, comprising the steps of:

(a) storing, in memory, a predetermined data map of prescribed data values associated with air-fuel ratios of said air-fuel mixture for a plurality of values of selected engine conditions;

(b) retrieving, from said memory, respective data values in accordance with sensed values of said selected engine conditions and controlling said air-fuel ratio of said air-fuel mixture in accordance with said retrieved data values; and (c) in response to the occurrence of a prescribed engine operation condition, interrupting step (b) and controlling said air-fuel ratio of said air-fuel mixture in accordance with the sensed prescribed characteristic of exhaust gas emitted from said engine, wherein step (c) comprises the steps of:

(c1) monitoring the output of said exhaust sensor and producing an exhaust feedback control signal in accordance therewith, and (c2) controlling said air-fuel mixture on the basis of said exhaust feedback control signal produced in step (c1), and further including the step of:

(d) in response to the occurrence of a predetermined engine operation condition, interrupting step (c) and reinitiating (b), and wherein the reinitiated step (b) comprises the steps of:

(b1) retrieving, from said memory, respective data values in accordance with sensed values of said selected engine conditions;

(b2) modifying said retrieved data values in accordance with said exhaust feedback control signal produced in step (c1), and (b3) controlling said air-fuel ratio of said air-fuel mixture in accordance with said modified data values.

9. A method according to claim 8, wherein said prescribed engine operation condition corresponds to the expiration of a preselected interval of time during which step (b) has been performed.

10. A method according to claim 8, wherein said prescribed engine operation condition corresponds to a change in the value of one of said selected engine conditions greater than a prescribed value differential.

11. A method according to claim 10, wherein said one of said selected engine conditions corresponds to the intake vacuum of the engine.

12. A method according to claim 10, wherein said one of said selected engine conditions corresponds to the speed of the engine.

13. A method according to claim 8, wherein said exhaust sensor includes means for sensing said prescribed characteristic of exhaust gas in accordance with a prescribed measurement cycle, and wherein said predetermined engine operation condition corresponds to the occurrence of a predetermined number of said measurement cycles.

14. A method according to claim 8, wherein said exhaust sensor comprises an oxygen sensor for detecting the concentration of oxygen in said exhaust gas.

15. A method according to claim 14, wherein said selected engine conditions correspond to engine speed and engine intake vacuum.

16. A method according to claim 8, wherein said air-fuel mixture fuel supply system comprises a carburetor having a low speed fuel supply system and a medium-high speed fuel supply system and wherein said air-fuel ratio is controlled in steps (b) and (c) by controlling said low speed fuel supply system and said medium-high speed fuel supply system.

17. A method according to claim 16, wherein each of said low and medium-high fuel supply systems comprises a respective solenoid-operated valve, the duty ratio of operation of which is controlled by steps (b) and (c).

18. A method according to claim 8, wherein said exhaust sensor includes means for sensing said prescribed characteristic of exhaust gas in accordance with a prescribed measurement cycle and wherein step (c1) initiates the monitoring of the output of said exhaust sensor at that point in the measurement cycle at which it was previously interrupted by step (d).

19. A method according to claim 18, wherein step (d) comprises the step of modifying the respective data values retrieved from memory in the reinitiated step (b), in accordance with the mean value of the level of said exhaust feedback control signal during the time that step (c) was carried out subsequent to the time that step (b) was previously interrupted until step (c) was interrupted.

20. A method according to claim 19, wherein the level of said exhaust feedback control signal produced at the initiation of step (c1) is established at the value of data retrieved in step (b) and modified by step (d) at the time of interruption of step (b).

21. A method of operating a processor-controlled apparatus for controlling the operation of an internal combustion engine having an air-fuel mixture supply system for supplying an air-fuel mixture to said engine, comprising the steps of:

(a) storing, in memory, a predetermined data map of prescribed data values associated with air-fuel ratios of said air-fuel mixture for a plurality of values of selected engine conditions;

(b) retrieving, from said memory, respective data values in accordance with sensed values of said selected engine conditions and controlling said air-fuel ratio of said air-fuel mixture in accordance with said retrieved data values; and (c) in response to the occurrence of a prescribed engine operation condition, executing a program for determining data modification values in accordance with which the respective data values retrieved in step (b) are to be modified; and (d) modifying the respective data values retrieved in step (b) by the modification values determined in step (c) and thereby controlling said air-fuel ratio of said air-fuel mixture in accordance with said modified data values.

22. A method according to claim 21, wherein step (c) comprises the step of interrupting step (b) and thereupon executing said program for determining said data modification values and step (d) is carried out upon completion of the execution of said program.

23. A method according to claim 22, wherein said prescribed engine operation condition corresponds to a change in the value of one of said selected engine conditions greater than a prescribed value differential.

24. A method according to claim 23, wherein said one of said selected engine conditions corresponds to the intake vacuum of the engine.

25. A method according to claim 23, wherein said one of said selected engine conditions corresponds to the speed of the engine.

26. A method according to claim 21, wherein said engine includes exhaust gas sensor means for sensing a prescribed characteristic of exhaust gas emitted from said engine, and step (c) comprises interrupting steps (b) and (d), and determining said modification values in accordance with the output of said exhaust gas sensor means, while controlling said air-fuel ratio of said air-fuel mixture in accordance with the sensed prescribed characteristic of exhaust gas emitted from said engine.

27. A method according to claim 26, wherein step (c) comprises the steps of:

(c1) monitoring the output of said exhaust sensor and producing an exhaust feedback control signal in accordance therewith, and (c2) controlling said air-fuel mixture on the basis of said exhaust feedback control signal produced in step (c1).

28. A method according to claim 27, further comprising the step of:

(e) in response to the occurrence of a predetermined engine condition, interrupting step (c) and reinitiating steps (b) and (d).

29. A method according to claim 28, wherein said exhaust sensor comprises an oxygen sensor for detecting the concentration of oxygen in said exhaust gas.

30. A method according to claim 28, wherein said exhaust sensor includes means for sensing said prescribed characteristic of exhaust gas in accordance with a prescribed measurement cycle, and wherein said predetermined engine operation condition corresponds to the occurrence of a predetermined number of said measurement cycles.

31. A method according to claim 21, wherein said prescribed engine operation condition corresponds to the expiration of a preselected interval of time during which step (b) has been performed.

32. A method according to claim 21, wherein said selected engine conditions correspond to engine speed and engine intake vacuum.

* * * * *